US012674448B2

(12) United States Patent
Lundin et al.

(10) Patent No.: US 12,674,448 B2
(45) Date of Patent: Jul. 7, 2026

(54) PUMP FOR A BIOPROCESSING SYSTEM

(71) Applicant: CYTIVA SWEDEN AB, Uppsala (SE)

(72) Inventors: Andreas Lundin, Uppsala (SE); Christopher Ford, Uppsala (SE); Klaus Gebauer, Uppsala (SE); Per Stromberg, Uppsala (SE)

(73) Assignee: Cytiva Sweden AB, Uppsala (SE)

( * ) Notice: Subject to any disclaimer, the term of this patent is extended or adjusted under 35 U.S.C. 154(b) by 0 days.

(21) Appl. No.: 18/847,659

(22) PCT Filed: Apr. 12, 2023

(86) PCT No.: PCT/EP2023/059554
§ 371 (c)(1),
(2) Date: Sep. 16, 2024

(87) PCT Pub. No.: WO2023/202928
PCT Pub. Date: Oct. 26, 2023

(65) Prior Publication Data

US 2025/0067258 A1 Feb. 27, 2025

(30) Foreign Application Priority Data

Apr. 22, 2022 (GB) ..... 2205883

(51) Int. Cl.
*F04B 43/073* (2006.01)
*F04B 43/00* (2006.01)
*F04B 53/16* (2006.01)

(52) U.S. Cl.
CPC ..... *F04B 43/0733* (2013.01); *F04B 43/0054* (2013.01); *F04B 43/0081* (2013.01); *F04B 53/16* (2013.01)

(58) Field of Classification Search
CPC ..... F04B 43/0733; F04B 43/0054; F04B 43/0081; F04B 53/16
See application file for complete search history.

(56) References Cited

U.S. PATENT DOCUMENTS 4,410,322 A * 10/1983 Archibald ..... A61M 5/168 417/478
5,078,581 A 1/1992 Blum et al.
(Continued)

FOREIGN PATENT DOCUMENTS

CA 1137812 A 12/1982
CN 202468240 U 10/2012
(Continued)

OTHER PUBLICATIONS

International Search Report and Written Opinion for PCT Patent Application No. PCT/EP2023/059554 Mailed Sep. 9, 2023.
(Continued)

*Primary Examiner* — Shafiq Mian
(74) *Attorney, Agent, or Firm* — Taft Stettinius & Hollister LLP

(57) ABSTRACT

The present disclosure relates to a pump (100, 1100, 2100) for providing substantially continuous liquid flow in a bioprocessing system (200), the pump (100, 1100, 2100) comprising: a pressurisable outlet chamber (122, 1122) in fluidic communication with an outlet (126, 1126, 2126) of the pump (100, 1100, 2100); and a pressurisable feed chamber (120, 1120) connected in series with the outlet chamber (122, 1122), wherein the feed chamber (120, 1120) is configured to fill the outlet chamber (122, 1122) during discharge of liquid from the outlet chamber (122, 1122).

19 Claims, 16 Drawing Sheets

(56) References Cited

U.S. PATENT DOCUMENTS

| | | | | |
|---|---|---|---|---|
| 5,269,811 | A | 12/1993 | Hayes | |
| 6,530,262 | B1 | 3/2003 | Esser | |
| 8,662,859 | B2 * | 3/2014 | Gonnella | F04B 49/06 417/2 |
| 8,747,978 | B2 | 6/2014 | Zhizhong | |
| 8,932,032 | B2 * | 1/2015 | Orr | F04B 43/0736 92/96 |
| 10,422,331 | B2 | 9/2019 | Ezzo et al. | |
| 10,451,591 | B1 | 10/2019 | Gebauer | |
| 10,527,033 | B2 | 1/2020 | Ezzo et al. | |
| 10,881,775 | B2 | 1/2021 | Wallace | |
| 2003/0129064 | A1 | 7/2003 | Cabuz et al. | |
| 2003/0136178 | A1 | 7/2003 | Cabuz | |
| 2009/0060756 | A1 * | 3/2009 | Jones | A61M 60/851 604/152 |
| 2009/0068032 | A1 | 3/2009 | Furey | |
| 2012/0100022 | A1 | 4/2012 | Fritsch | |
| 2012/0177506 | A1 | 7/2012 | Oerter | |
| 2015/0219089 | A1 * | 8/2015 | Glauber | F04B 43/0733 417/472 |
| 2015/0306596 | A1 * | 10/2015 | Thompson | F04B 43/12 422/505 |
| 2016/0226042 | A1 * | 8/2016 | Hartmann | H01M 50/213 |
| 2017/0203023 | A1 | 7/2017 | Farrell | |
| 2020/0116143 | A1 | 4/2020 | Boerema | |
| 2021/0268748 | A1 * | 9/2021 | Frische | B29C 66/028 |

FOREIGN PATENT DOCUMENTS

| | | | |
|---|---|---|---|
| CN | 206368788 | U | 8/2017 |
| CN | 218266271 | U | 1/2023 |
| EP | 0156211 | A2 | 10/1985 |
| JP | 4098103 | B2 | 8/2004 |
| WO | 2009029666 | A | 3/2009 |
| WO | 2013062480 | A1 | 2/2013 |
| WO | 2014177578 | A1 | 6/2014 |

OTHER PUBLICATIONS

Great Britain Search Report for Great Britain Application No. GB2305344.0 dated Mar. 28, 2024.

Great Britain Search Report for Great Britain Application No. GB2205883.8 dated Oct. 10, 2022.

International Search Report and Written Opinion for PCT Patent Application No. PCT/EP2023/059622 Mailed Jun. 28, 2024.

Anonymous: "Glass Transition Temperature (Tg) of Polymers", Aug. 25, 2023, pp. 1-7, XP093076314.

European Patent Office, Exam Report regarding European Application No. 23719690.2 mailed Nov. 4, 2025 (5 pages).

European Patent Office, regarding European Application No. 23719690.2-1009, mailed Jan. 20, 2026.

* cited by examiner

PUMP FOR A BIOPROCESSING SYSTEM

FIELD

The present disclosure relates to a pump for a bioprocessing system, a bioprocessing system comprising the pump, and a method of operating the pump.

BACKGROUND

Bioprocessing systems typically require effective liquid handling in order to carry out processes under controlled and contained conditions. This may involve aseptic handling in closed liquid handling systems and the use of pre-sterilised components.

Recently, modular bioprocessing systems based on single-use flow paths have been developed. The single-use components are implemented as modular consumables that are intended to be disposed of after a process run. Single-use flow path components eliminate the time- and labour-consuming pre- and post-cleaning of the wetted flow path. This increases the overall process efficiency and reduces cost. The elimination of equipment cleaning and any associated cleaning validation processes also greatly reduces the risk of cross-contamination between different batches being processed using the bioprocessing system.

Single-use components are, by their nature, disposed of after use. Therefore, it is beneficial to minimise the cost of such single-use components, while maximising the ease of production. Moreover, it is beneficial to provide single-use components that are configurable for a range of liquid handling processes, in order to minimise the number of types of single-use component that are needed for a particular liquid handling operation. Further, it is beneficial to provide single-use components that are flexible and scalable to adapt to different processing capacity or processing needs. Pumps or valves, for example, may need to be provided in different sizes to handle a range of liquids to be processed in different volumes and/or with different flow rates.

An example of a single-use component that includes pneumatically or hydraulically actuated diaphragm valves is described in U.S. Pat. No. 10,451,591. This document describes a valve system in which a pneumatic or hydraulic control system controls the application of pneumatic or hydraulic pressure to actuate diaphragm valves in a valve block forming part of a single-use flow path. The diaphragm valves are used to control the flow of liquid in the single-use flow path. Prior to actuation of the diaphragm valves, the valve block is coupled to a connector unit that allows for connection and disconnection of conduits in the pneumatic or hydraulic control system with conduits of the valve block.

Bioprocessing comprises a range of different liquid handling operations. Requirements on the liquid handling equipment, for example pumps and valves, may be different depending on the type of processing operation, usually called Unit Operation (UOp). A range of crucial separation and purification Unit Operations, for example tangential flow filtration (TFF) and chromatography, require pumps delivering a continuous and pulsation-free liquid to achieve the efficiency and reproducibility required in biopharmaceutical processing.

In TFF, continuous and substantially pulsation-free liquid flow enables stable conditions at the filtration device in terms of flow and pressure to achieve high efficiency and performance of the separation and to avoid fouling of the filter device. In chromatography, continuous and accurate liquid flow is a pre-requisite for good control and reproducibility of the operation, allowing for accurate separation of different effluent fractions to collect the drug substance of interest with desired purity and yield. There are other Unit Operations in bioprocessing where continuous and stable, pulsation-free flow is needed or advantageous, for example in single pass TFF operations, normal flow filtration, plug flow reactions, mixing operations, etc.

Current pump technologies for bioprocessing systems are typically based on pump design solutions that directly engage liquid displacement parts inside the pump, such as pistons, diaphragms, lobe rotors, centrifugal rotors or a peristaltic tube by the use of motors or electrical drives attached to the pump. Especially for single-use technology, the need for directly pairing and connecting a re-usable drive unit with a single-use disposable pump unit gives significant limitations in regard to several aspects, for example an efficient utilization of space, flexibility in arranging, integrating and miniaturizing liquid handling components, as well as usability in installing, removing and replacing single-use processing liquid handling units as consumable devices.

Especially when reducing scale and working volumes for single-use bioprocessing, as is needed for production of drug substances for individualized therapies, for example, current technology is not suited to facilitate the physical miniaturization needed to provide single-use consumables of small physical size and low liquid hold-up volume, which is required for achieving high separation efficiency as well as enabling cost efficient solutions that are easy and safe to use.

Therefore, there is a need for providing single-use systems and components that achieve high efficiency and scalability for processing of small volumes. In particular, there is a need for providing pump solutions which provide continuous and substantially pulsation-free flow for small scale single-use separations that minimise cost and complexity of such single-use components.

SUMMARY

This summary introduces concepts that are described in more detail in the detailed description. It should not be used to identify essential features of the claimed subject matter, nor to limit the scope of the claimed subject matter.

According to a first aspect of the present disclosure, there is provided a pump for providing substantially continuous liquid flow in a bioprocessing system, the pump comprising: a pressurisable outlet chamber in fluidic communication with an outlet of the pump; and a pressurisable feed chamber connected in series with the outlet chamber, wherein the feed chamber is configured to fill the outlet chamber during discharge of liquid from the outlet chamber.

By providing a feed chamber that fills the outlet chamber during discharge of liquid from the outlet chamber, the level of liquid in the outlet chamber can be topped up, meaning that the flow of liquid from the outlet of the pump is substantially continuous (i.e. not interrupted during processing of a liquid volume). The pressurisable outlet chamber allows a constant pressure to be applied to the outlet chamber, meaning that the outlet flow has low pulsations.

Each of the chamber and the outlet chamber may be pressurisable by deformation of a respective flexible diaphragm of the chamber. In particular, each respective flexible diaphragm may be deformable by application of a control fluid to the flexible diaphragm. In this way, the respective diaphragms can be pressurized and displaced in a controlled manner to achieve a desired change in liquid volume at desired pressure, thereby resulting in a desired liquid flow rate from the pump.

According to a second aspect of the present disclosure, there is provided a bioprocessing system comprising: the pump of the first aspect; and a control system for applying pressure to the chambers of the pump, wherein the control system is configured to: apply pressure to the outlet chamber of the pump to discharge liquid from the outlet chamber; and during application of the pressure to the outlet chamber: apply a first pressure to the feed chamber of the pump to fill the feed chamber; and apply a second pressure to the feed chamber to discharge liquid from the feed chamber to the outlet chamber, wherein the second pressure is higher than the first pressure.

The control system may be configured to apply pressure to each of the chambers of the pump by deforming a respective flexible diaphragm of the chamber. In particular, the control system may be configured to deform each respective flexible diaphragm by supplying a control fluid to deform the flexible diaphragm.

According to a third aspect of the present disclosure, there is provided a method of operating the pump of according to the first aspect, the method comprising: applying pressure to the outlet chamber of the pump to discharge liquid from the outlet chamber; during the application of pressure to the outlet chamber, applying a first pressure to the feed chamber of the pump to fill the feed chamber; and during the application of pressure to the outlet chamber, applying a second pressure to the feed chamber to discharge liquid from the feed chamber, wherein the second pressure is higher than the first pressure.

Applying pressure to each of the chambers of the pump may comprise deforming a respective flexible diaphragm of the chamber. In particular, deforming each respective flexible diaphragm may comprise supplying a control fluid to deform the flexible diaphragm.

BRIEF DESCRIPTION OF FIGURES

Specific embodiments are described below by way of example only and with reference to the accompanying drawings, in which.

DETAILED DESCRIPTION

Implementations of the present disclosure are explained below with particular reference to bioprocessing systems. It will be appreciated, however, that the fluid actuated pump described herein may also be applied to other liquid handling operations, such as liquid handling operations in which a substantially continuous outlet flow is desired.

Figure 1:
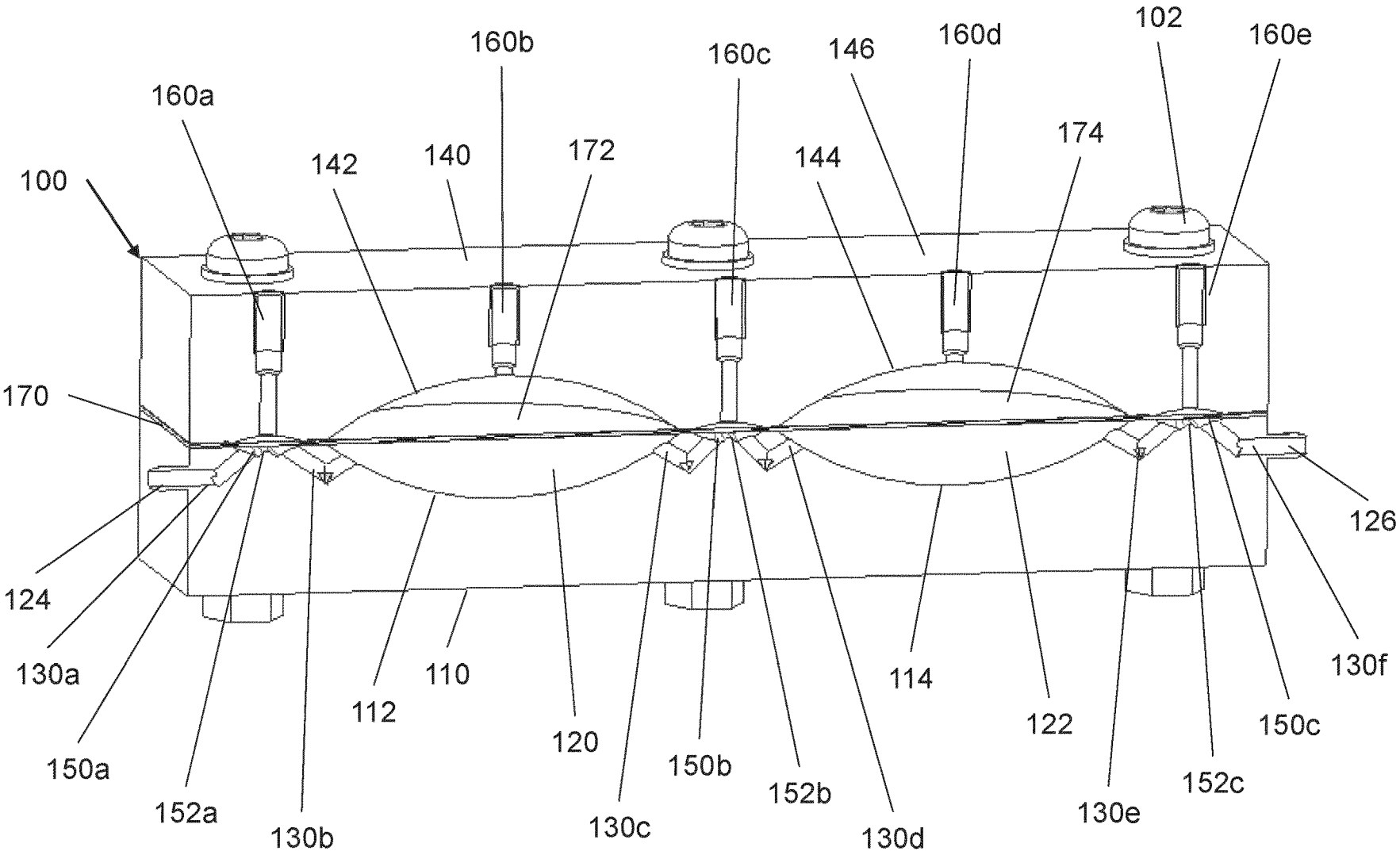
FIG. 1 is a perspective section view through a fluid actuated pump according to a first embodiment.
Figure 2:
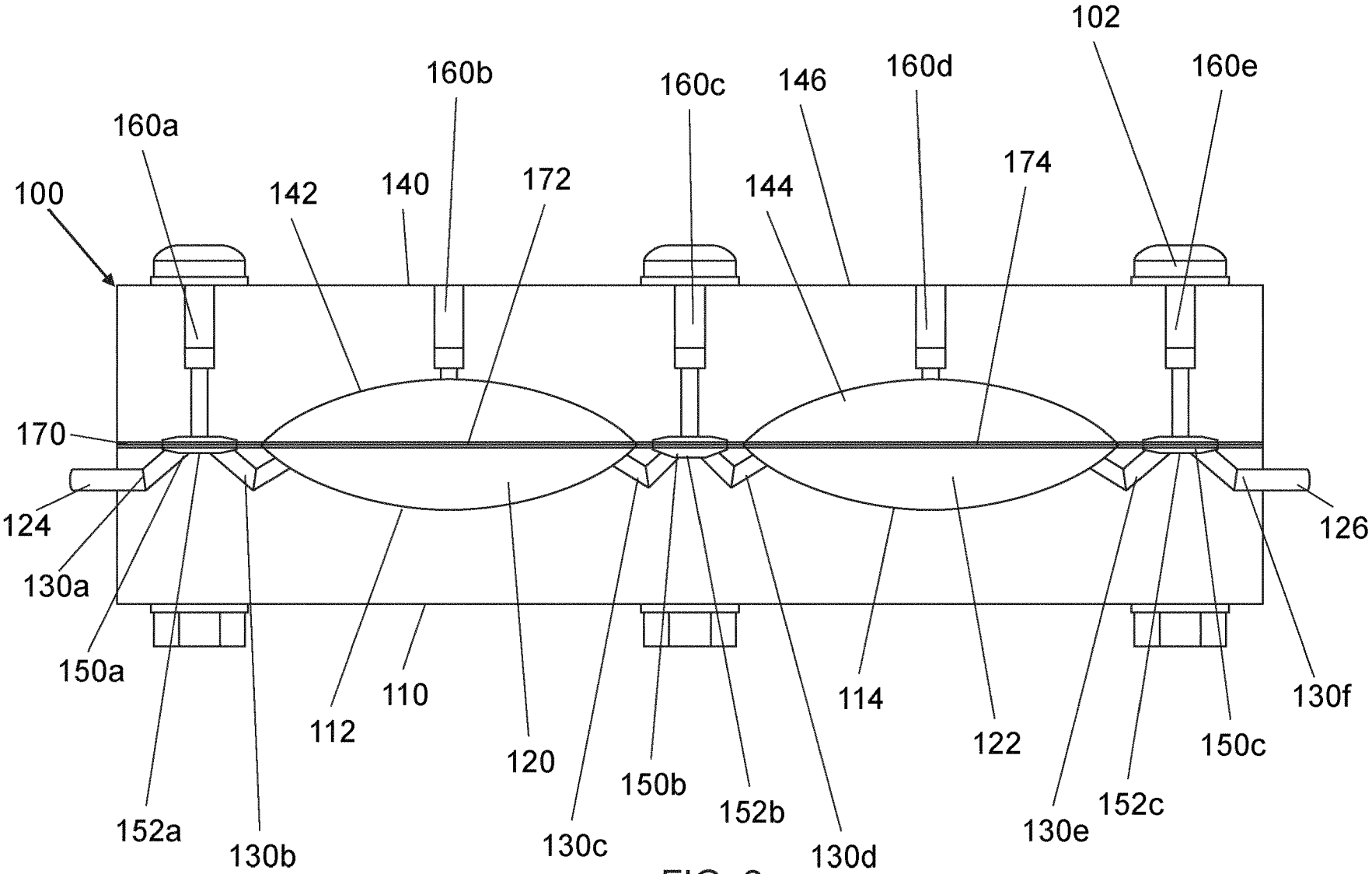
FIG. 2 is a side section view through the fluid actuated pump shown in FIG. 1.
Figure 3:
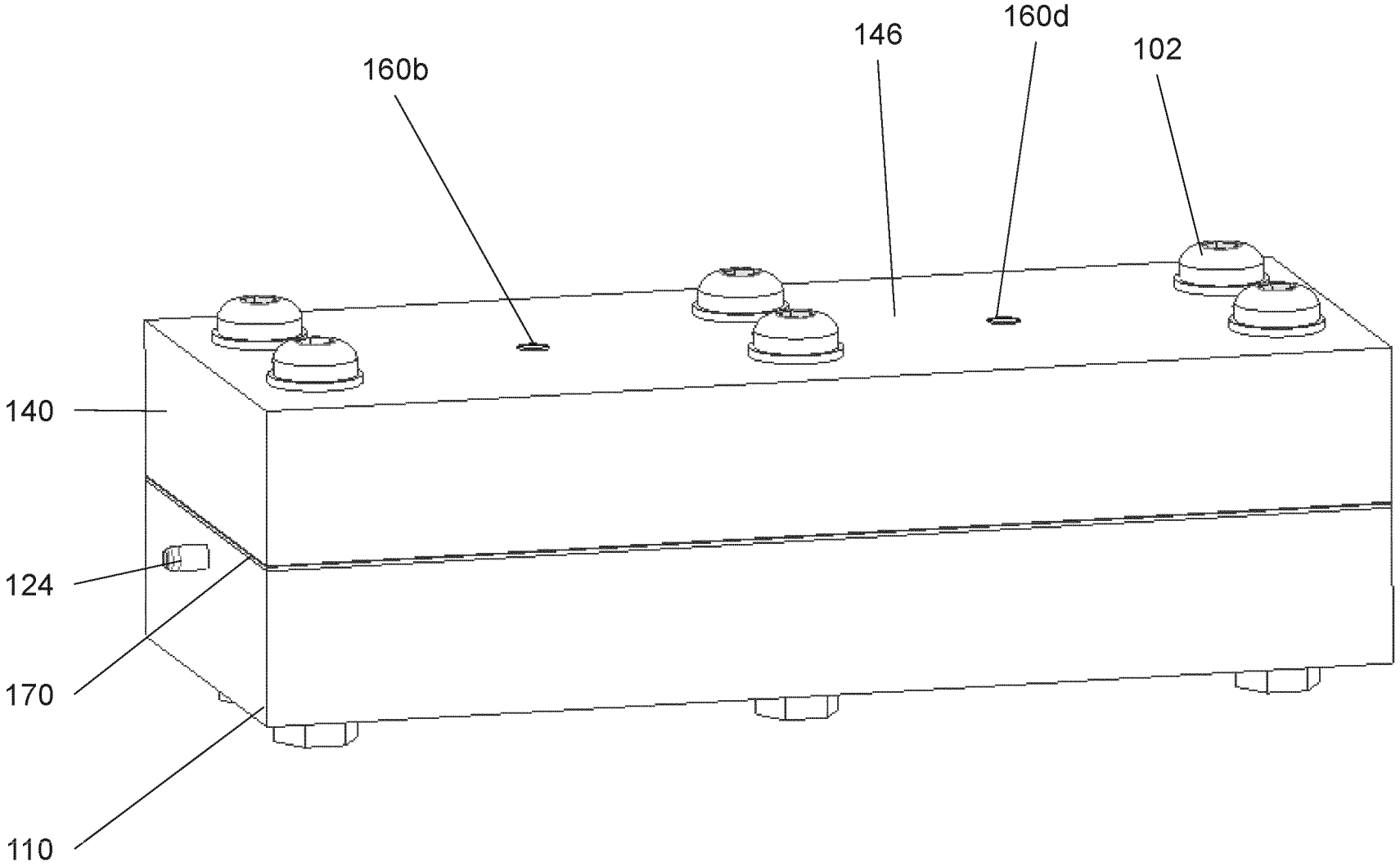
FIG. 3 is a perspective view of the fluid actuated pump shown in FIG. 1.

FIG. 1 is a perspective section view through a single-use bioprocessing component in the form of a fluid actuated pump 100 according to a first embodiment, while FIG. 2 is a side section view through the fluid actuated pump 100. FIGS. 1 and 2 show the fluid actuated pump 100 in section view, so that the internal components of the fluid actuated pump 100 can be seen. A non-section view of the fluid actuated pump is shown in FIG. 3.

As shown in FIGS. 1 and 2, the fluid actuated pump 100 is formed of a first part 110 (shown as a lower part in the example of FIG. 1) and a second part 140 (shown as an upper part in the example of FIG. 1). The first part 110 is a liquid handling part, and includes conduits and chambers for handling the liquid being processed by the bioprocessing system (which may be or include, for example, a drug formulation, monoclonal antibody (MAB), mRNA, etc.). The second part 140 is a control fluid part, and includes conduits and chambers for applying pressure to a diaphragm 170 (described below), in order to control the flow of liquid in the first part 110.

The diaphragm 170 is sandwiched between the first part 110 and the second part 140. The diaphragm 170 is impermeable to gas, thereby allowing the diaphragm 170 to be displaced by application of pressure to the diaphragm 170 using a control fluid (which may, in some examples, be a gas).

The diaphragm 170 may, for example, be formed of a polymer that is sufficiently pliant to permit deflection when a pressure is applied. Such pliant pressure-responsive material may, for example, be a fluoropolymer or an elastomer. As one specific example, the diaphragm 170 is formed of perfluoroalkoxy copolymer resin thermoplastic material. Materials such as silicone rubber, EPDM rubber and thermoplastic elastomers (TPE) may alternatively be used. A TPE is particularly suitable for bonding to the first part 110 and/or the second part 140. One example of a particularly suitable TPE for the diaphragm 170 is Mediprene® TPE from Hexpol AB of Malmö, Sweden.

Suitable materials for the first part 110 and second part 140 include, for example, polypropylene, polymethylpentene (also known as TPX®), and cyclic olefin copolymer (COC). One example of a particularly suitable material for the first part 110 and the second part 140 is COC with a low glass transition temperature (e.g. $T_g$ between 60° C. and 100° C., and preferably between 70° C. to 85° C.) to accommodate bonding to a TPE such as Mediprene®. It will be appreciated that other glass transition temperature ranges will be applicable for alternative polymers, in order to accommodate bonding to the diaphragm 170. However, in examples in which the diaphragm 170 is clamped or screwed to the first part 110 and/or second part 140 (instead of being bonded), materials such as stainless steel may be used for the first part 110 and/or second part 140, along with an elastomeric diaphragm material such as Kalrez® elastomers from DuPont of Wilmington, Delaware, US.

In various preferred embodiments, diaphragm 170 comprises TPE (with at least one thermoplastic and at least one elastomeric component) and is bonded to a first part 110 and/or a second part 140 that comprise(s) cyclic olefin copolymer (COC). Bonding between such components may be provided by temperature induced heat/diffusion bonding, for example.

The elastomeric component may comprise a SEBS (Styrene-Ethylene-Butadiene-Styrene) matrix, which can provide several glass transition temperatures to provide the elastomeric component with different properties. For example, there may also be included therein soft segments such as polyethylene and polybutadiene, and stiff segments such as polystyrene.

The TPE based diaphragm 170 also comprises at least one material component that has a glass transition temperature (Tg) that is matched to the glass transition temperature (Tg) of the COC. This material component may be a thermoplastic used, for example, to replace the polypropylene that is otherwise used in a conventional TPE based membrane.

For example, COC8007 may be used with Tg=65-95° C. One or more thermoplastic component (with a lower Tg or melting temperature than polypropylene) added into the TPE based membrane may then be used to provide a Tg that is substantially matched thereto.

Matching of the Tg properties in this way enables improved diffusion bonding to occur by way of molecular movement between the components and provides a strong bond therebetween. The TPE based diaphragm 170 may thus be used to provide extra structural support to affix the first part 110 and the second part 140 together or might, alternatively, be used solely to provide such support therebetween.

Generally, the materials used for construction of single-use bioprocessing components should be compatible with typical sterilisation methods, such as gamma or X-ray irradiation and/or ethylene oxide sterilisation. Further, materials used for components that are in contact with process fluids (so-called "wetted parts") should be in compliance with material requirements satisfying the demands of regulatory authorities and current best practice and standards in cGMP processing, such as, for example, being of animal-free origin, being in compliance with USP (class 6) requirements, and so on.

As shown in FIGS. 1 to 3, the first part 110 and the second part 140 are held together using fixings 102 (e.g. bolts or screws), thereby sandwiching the diaphragm 170 in place.

Referring back to FIGS. 1 and 2, the first part 110 includes two concave cavities 112, 114, while the second part 140 also includes two concave cavities 142, 144 that are aligned with the cavities 112, 114 in the first part 110. The cavities 112, 114 of the first part 110 and the cavities 142, 144 of the second part 140 are separated by the diaphragm 170. For ease of reference, the portion of the diaphragm 170 that divides cavities 112 and 142 is referred to herein as diaphragm 172, while the portion of the diaphragm 170 that divides cavities 114 and 144 is referred to herein as diaphragm 174. As best shown in FIG. 1, the diaphragm 172 covers the first cavity 112 in the first part 110, while the diaphragm 174 covers the second cavity 114 in the first part 110. It will be appreciated that the diaphragms 172, 174 may alternatively be implemented using separate diaphragms (i.e. not part of the same diaphragm 170). However, implementing a single diaphragm 170 to provide the diaphragms 172, 174 simplifies manufacture of the pump 100.

As shown in FIGS. 1 and 2, a first chamber 120 (also referred to herein as a "feed chamber") has a volume defined by the cavity 112 and the diaphragm 172. The diaphragm 172 therefore forms a wall of the first chamber 120. The volume of the first chamber 120 varies as the diaphragm 172 is deformed. In particular, the volume of the first chamber 120 is at a minimum when the diaphragm 172 is fully deformed into the first cavity 112 of the first part 110 (e.g. by applying a positive pressure to the diaphragm 172 via a control fluid supplied through conduits in the second part 140). Likewise, the volume of the first chamber 120 is at a maximum when the diaphragm 172 is fully deformed into the first cavity 142 of the second part 140 (e.g. by application of a negative pressure to the diaphragm 172 to draw liquid into the first chamber 120).

A second chamber 122 (also referred to herein as an "outlet chamber") has a volume defined by the cavity 114 and the diaphragm 174. The diaphragm 174 therefore forms a wall of the second chamber 122. The second chamber 122 is connected in series with the first chamber 120 (i.e. liquid flows through the first chamber 120, and subsequently flows into the second chamber 122). As with the first chamber 120, the second chamber 122 has a minimum volume when the diaphragm 174 is fully deformed into the second cavity 114 in the first part 110, and a maximum volume when the diaphragm 174 is fully deformed into the second cavity 144 in the second part 140.

The diameters of the first chamber 120 and the second chamber 122 are preferably between approximately 5 mm and approximately 50 mm. The thickness of the diaphragm 170 is preferably between approximately 0.3 mm and approximately 2.0 mm, more preferably between approximately 0.4 mm and approximately 1.0 mm, and more preferably approximately 0.5 mm.

In the following description, the first chamber 120 is also referred to herein as a "feed chamber", while the second chamber 122 is referred to as an "outlet chamber". This configuration assumes that liquid flow in the pump 100 is in the direction from left to right. The pump 100 is, however, configured for reversible flow, meaning that the second chamber 122 can be used as a feed chamber and the first chamber 120 can be used as an outlet chamber, in a reverse flow configuration.

The first part 110, second part 140 and diaphragm 170 also cooperate to define a number of diaphragm valves 150 of the fluid actuated pump 100. In particular, these components cooperate to define a first diaphragm valve 150*a* at an inlet to the first chamber 120, a second diaphragm valve 150*b* disposed between the first chamber 120 and the second chamber 122, and a third diaphragm valve 150*c* at an outlet from the second chamber 122.

Each diaphragm valve 150 is defined by a cavity in the first part 110 and a corresponding cavity in the second part 140. The cavities in the first part 110 that define the diaphragm valves 150 each include a protrusion defining a valve seat 152, against which the diaphragm 170 is urged in order to close the valve 150. In particular, the first part 110 defines a valve seat 152*a* of the first diaphragm valve 150*a*, a valve seat 152*b* of the second diaphragm valve 150*b*, and a valve seat 152*c* of the third diaphragm valve 150*c*.

Each diaphragm valve 150 is closed by urging the diaphragm 170 against its respective valve seat 152. For example, a positive pressure may be applied to the diaphragm 170 via a control fluid supplied through conduits in the second part 140, in order to deform the diaphragm 170 so that it contacts the valve seat 152. Alternatively, the diaphragm 170 may be in contact with the valve seat 152 when no pressure is applied (i.e. when the diaphragm 170 is in an undeformed state).

Likewise, each diaphragm valve 150 is opened by deforming the diaphragm 170 away from its respective valve seat 152. For example, a negative pressure may be applied to the diaphragm 170 via conduits in the second part 140, in order to deform the diaphragm 170 away from the valve seat 152 (e.g. if the diaphragm 170 is in contact with the valve seat 152 in an undeformed state). Alternatively, the diaphragm 170 may not be in contact with the valve seat 152 when no pressure is applied (i.e. when the diaphragm 170 is in an undeformed state).

The first part 110 includes a liquid inlet 124 that allows liquid to flow into the fluid actuated pump 100, and a liquid outlet 126 that allows liquid to flow out of the fluid actuated pump 100.

The first part 110 also includes a plurality of liquid supply conduits 130 that provide fluidic connections between the diaphragm valves 150 and the chambers 120, 122.

Specifically, the first part 110 includes: an inlet conduit 130*a* that provides a fluidic connection between the liquid inlet 124 and the first diaphragm valve 150*a*; a feed chamber inlet conduit 130*b* providing a fluidic connection between the first diaphragm valve 150*a* and the first (feed) chamber 120; a feed chamber outlet conduit 130*c* providing a fluidic connection between the first (feed) chamber 120 and the second diaphragm valve 150*b*; an outlet chamber inlet conduit 130*d* providing a fluidic connection between the second diaphragm valve 150*b* and the second (outlet) chamber 122; an outlet chamber outlet conduit 130*e* providing a fluidic connection between the second (outlet) chamber 122 and the third diaphragm valve 150*c*; and an outlet conduit 130*f* providing a fluidic connection between the third diaphragm valve 150*c* and the liquid outlet 126.

Each of the liquid supply conduits 130 does not contact the diaphragm 170. In addition, as shown in FIGS. 1 and 2, each of the liquid supply conduits 130 can include a portion that extends away from the plane of the diaphragm 170, so as to avoid interference with the diaphragm 170.

The second part 140 includes a plurality of control fluid supply conduits 160 that provide fluidic connections to the cavities in the second part 140 that define the chambers 120, 122 and the diaphragm valves 150. The control fluid supply conduits 160 extend between components of the fluid actuated pump 100 and an exterior surface 146 of the second part 140 (as indicated in FIG. 3).

Specifically, referring back to FIGS. 1 and 2, the second part 140 includes: a first control fluid supply conduit 160*a* extending between an exterior surface 146 of the second part 140 and the first diaphragm valve 150*a*; a second control fluid supply conduit 160*b* extending between the exterior surface 146 and the first cavity 142 in the second part 140; a third control fluid supply conduit 160*c* extending between the exterior surface 146 and the second diaphragm valve 150*b*; a fourth control fluid supply conduit 160*d* extending between the exterior surface 146 and the second cavity 144 in the second part 140; and a fifth control fluid supply conduit 160*e* extending between the exterior surface 146 and the third diaphragm valve 150*c*.

As shown in FIGS. 1 and 2, the control fluid supply conduits 160 can extend in a straight line between the exterior surface 146 and a respective component (diaphragm valve 150, cavity 142, 144). In particular, for the second and fourth control fluid supply conduits 160*b*, 160*d*, the length of the control fluid supply conduit 160 is equal to the shortest distance between the cavity 142, 144 and the exterior surface 146. In other words, these control fluid supply conduits 160*b*, 160*d* extend between an apex of the cavity 142, 144 and the exterior surface 146. This serves to minimise the length of the second and fourth control fluid supply conduits 160*b*, 160*d*, which optimises the responsiveness of the actuation of the diaphragms 172, 174 by the control fluid.

The control fluid is supplied via the control fluid supply conduits 160, in order to control the flow of liquid through the fluid actuated pump 100. In particular, a control fluid (e.g. air) is supplied in order to deform the diaphragm 170 (e.g. to close one of the diaphragm valves 150, or to force liquid out of one of the chambers 120, 122). For example, the control fluid may exert a positive pressure on the diaphragm 172 via the second control fluid supply conduit 160*b*, to force liquid out of the first chamber 120 and into the second chamber 122 (assuming that the second diaphragm valve 150*b* is open and all other diaphragm valves 150 are closed). As another example, a negative pressure may be applied via the second control fluid supply conduit 160*b*, to aspirate liquid into the first chamber 120 through the liquid inlet 124 (assuming that the first diaphragm valve 150*a* is open and all other diaphragm valves 150 are closed). Applying a negative pressure to the diaphragm 172 of the first chamber 120 allows the position of the diaphragm 172 to be controlled in order to maximise the volume of the first chamber 120.

The control fluid can be a liquid or a gas. For example, hydraulic control may be provided using a liquid to apply pressure to the diaphragm 170. The incompressibility of a liquid control fluid provides a stiffer control of the diaphragm 170. However, pneumatic control using a gaseous control fluid (e.g. air) allows the diaphragm 170 to be controlled using a dry control fluid that gives appropriate performance.

The fluid actuated pump 100 shown in FIGS. 1 to 3 includes three diaphragm valves 150, as described above. The third diaphragm valve 150*c* is, however, optional, as a substantially continuous outlet flow can be provided without actuation of the third diaphragm valve 150*c*. Implementing the third diaphragm valve 150*c* at the outlet from the outlet chamber 122 helps with overall volume and flow control, by providing an on/off function. In addition, the third diaphragm valve 150*c* can be deployed as a pressure control valve, to help achieve constant conditions at the outlet 126 from the fluid actuated pump 100 (and downstream of the pump 100). The third diaphragm valve 150*c* can also be used for flow rate control, in order to provide a desired flow rate at the outlet 126 from the pump 100, or for stopping the liquid flow in order to contain a liquid volume (e.g. if the flow path and/or flow direction are changed downstream of the pump 100). Further, the third diaphragm valve 150*c* allows for reversible flow through the fluid actuated pump 100, in which the third diaphragm valve 150*c* is used as an inlet valve.

In addition, it is not necessary for the feed chamber 120 and the outlet chamber 122 to be equal in size. Equal sized chambers do, however, allow for simpler control of reversible flow through the pump 100.

The pump 100 described above is configured to provide substantially continuous liquid flow through the outlet 126. The term "substantially" continuous is intended to convey that the flow of liquid from the outlet 126 is uninterrupted during pumping of a sample volume (typically less than 1000 ml and preferably less than 100 ml). It will be appreciated, of course, that the flow of liquid from the outlet 126 stops once the entire sample volume has passed through the pump 100. The operation of the pump 100 to provide the substantially continuous flow is described with reference to the method 400 shown in FIG. 4. The method 400 may be implemented using the control system 220 illustrated in FIG. 5 (described below).

At 402, pressure is applied to the outlet chamber 122. In particular, pressure is applied to the diaphragm 174 of the outlet chamber 122, to discharge liquid from the outlet chamber 122 through the liquid outlet 126.

At 404, during application of pressure to the outlet chamber 122, a first pressure is applied to the feed chamber 120. In particular, the first pressure is applied to the diaphragm 172 of the feed chamber 120, to fill the feed chamber 120 via the liquid inlet 124. The first pressure is a negative gauge pressure that is lower than the static pressure of the liquid connected to the liquid inlet 124. In order to prevent the flow of liquid from the feed chamber 120 to the outlet chamber 122, the second diaphragm valve 150*b* is closed during filling of the feed chamber 120.

At 406, during application of pressure to the outlet chamber 122, a second pressure is applied to the feed chamber 120. The second pressure is higher than the first pressure. In particular, the second pressure is applied to the diaphragm 172 of the feed chamber 120, to discharge liquid from the feed chamber 120 to the outlet chamber 122. In order to prevent the flow of liquid through the inlet 124, the first diaphragm valve 150*a* is closed during discharge of the feed chamber 120.

Steps 404 and 406 can then be repeated until the entire liquid volume has been pumped.

The second pressure applied to the feed chamber 120 at 406 is higher than the pressure applied to the outlet chamber 122. This ensures that liquid flows from the feed chamber 120 to the outlet chamber 122, and not from the outlet chamber 122 to the feed chamber 120. In particular, the second pressure applied to the diaphragm 172 of the feed chamber 120 is high enough to drive liquid into the outlet chamber 122 at a higher flow rate than the flow of liquid through the outlet 126, thereby causing a net flow of liquid into the outlet chamber 122.

In addition, the pressures applied to the diaphragm 172 during filling (step 404) and emptying (step 406) of the feed chamber 120 should be sufficient to refill the feed chamber 120 before the outlet chamber 122 is emptied. Preferably, the time taken to fill and subsequently empty the feed chamber 120 should be the same as the time taken to discharge a volume equivalent to the feed chamber 120 from the outlet chamber 122, to avoid gradual filling or emptying of the outlet chamber 122. In other words, the volume of liquid flowing into the outlet chamber 122 during one cycle (i.e. filling and discharge) of the feed chamber 120 should be the same as the volume of liquid flowing through the liquid outlet 126 during one cycle of the feed chamber 120.

As a result of constantly topping up the volume of liquid within the outlet chamber 122 using pulses of liquid from the feed chamber 120, the flow of liquid through the outlet 126 is uninterrupted. In other words, the pump 100 provides continuous outlet flow for the sample volume that is being pumped.

The maximum pump flow rate can be achieved by minimising the cycle time (i.e. filling and discharge of the feed chamber 120). The factors that affect the cycle time include the ability to move fluid in and out of the feed chamber 120, the response rate of the control fluid supply system, and the dynamic response of the diaphragm 170. To optimise the cycle time, discharge in the connecting liquid supply conduits 130 should be maximised, the diaphragm 170 should be as compliant as possible, and control fluid supply lag should be minimised. The maximum pressures that can be used are also limited by the diaphragm valves 150, as such valves will eventually fail and admit fluid if the pressures applied to the diaphragm 170 are too high.

In an alternative embodiment, two or more feed chambers may be fluidically connected to the outlet chamber. The feed chambers may be pressurised so as to discharge liquid sequentially into the outlet chamber. In such an implementation, a higher flow rate could be realised, as the sequential discharge of liquid from multiple feed chambers would allow more time for filling the individual feed chambers. Moreover, the pump may include a plurality of feed chambers, a subset of which may be selected based on the desired liquid flow rate at the outlet of the pump. For example, an arrangement with multiple feed chamber may be configured to utilise a smaller subset of the multiple feed chambers (but at least one) for achieving a low flow rate at the pump outlet, while being configured to utilise a larger subset of the multiple feed chambers (at least two) for achieving a high flow rate.

Figure 5:
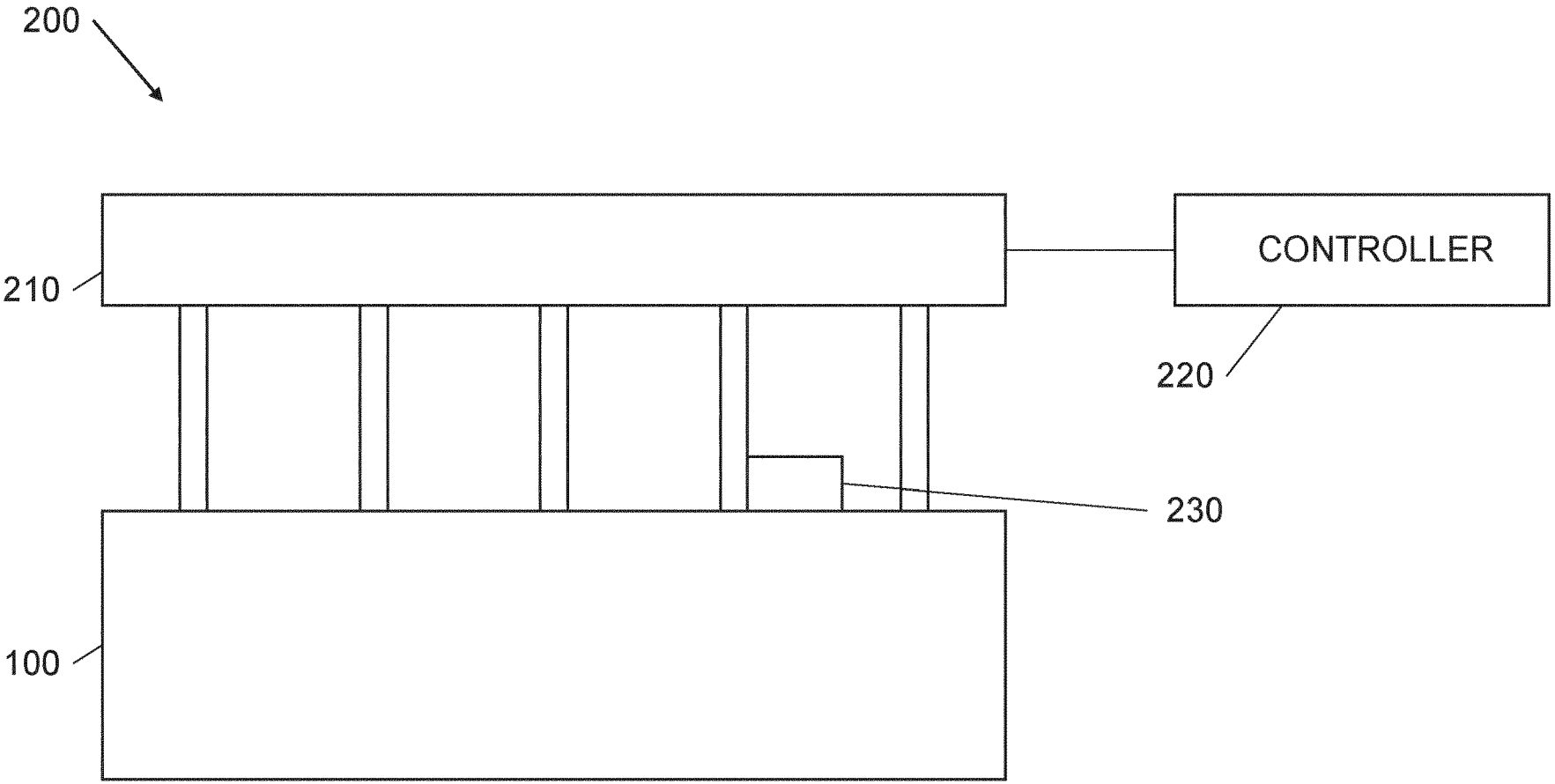
FIG. 5 is a schematic diagram of system comprising a fluid actuated pump.

FIG. 5 is a schematic diagram of a system 200 comprising the fluid actuated pump 100 shown in FIGS. 1 to 3. The system 200 comprises a control fluid supply system 210 that is configured to supply a control fluid to the control fluid supply conduits 160 of the pump 100. In one example, the control fluid supply system 210 is a pneumatic supply system that supplies pressurised air to the diaphragms 172, 174 and the diaphragm valves 150.

The control fluid supply system 210 includes five supply conduits 212 for supplying the control fluid to the control fluid supply conduits 160 of the pump 100. Three of these conduits 212 are used for opening and closing the diaphragm valves 150 (e.g. by application of a positive pressure to close the diaphragm valves 150 and/or application of a negative pressure to open the diaphragm valves 150). The remaining two conduits 212 are used for pressurising the diaphragms 172, 174 using the control fluid.

The system 200 also comprises a control system 220, optionally comprising a PID controller or other type of feedback control, configured to monitor and control the pressures applied to the diaphragms 172, 174 via the control fluid supply system 210, and to control the operation of the diaphragm valves 150 via the control fluid supply system 210. In addition, the system may comprise one or more sensors 230 or sensing means for monitoring the position of the diaphragm 174 in the second chamber 122, or means for calculating one or more positions of the diaphragm in the first chamber 120 and/or the second chamber 122.

In order to monitor the position of the diaphragm 172 in the first chamber 120 and/or the diaphragm 174 in the second chamber 122, sensing may be performed at the pump diaphragm, either as fixed position (end point) position sensing or alternatively as continuous higher resolution sensing. Examples of suitable sensors include proximity sensors such as optical sensors (reflection, light intensity) or capacitive sensors, or optical CCD camera methods for determining diaphragm position through focus sensing; position sensors such as mechanical or ultrasonic position sensors; diaphragm opacity and/or colour measurements (i.e. by indirect measurement of diaphragm thickness, which is coupled to stress (Poission coupling); mechanical sensors using stress and/or strain measurements of the diaphragm, for example, by direct embedded strain gauge, optical measurements (utilising a random speckle pattern, for example), or thermal measurements; and/or cavity resonance (volume measurement for measuring the volume of the cavities either side of the diaphragm), for example, by acoustic excitation/attenuation (e.g. as with a Helmholtz resonator).

As further examples, sensing of the diaphragm position can be done indirectly and outside of the pump 100 and single-use consumable, for example at the control system. Examples for such sensing means include sensing means for monitoring and evaluating pressure and/or flow rate in the pneumatic control system that is in direct communication with the diaphragm in the single-use consumable.

Monitoring the position of the diaphragm 172 allows a determination to be made as to when to switch from applying positive pressure to the diaphragm 172 to applying negative pressure to the diaphragm 172. Monitoring the position of the diaphragm 174 allows for a determination of whether or not the outlet chamber 122 is gradually filling or gradually emptying, allowing the pressures applied to the feed chamber 120 and/or outlet chamber 122 to be tuned accordingly, for example to keep the diaphragm 174 in an intermediate position in between the confining walls of the outlet chamber 122 such that outlet chamber 122 is partially filled with liquid and the filling volume is kept in between desired filling volumes (or levels).

Figure 4:
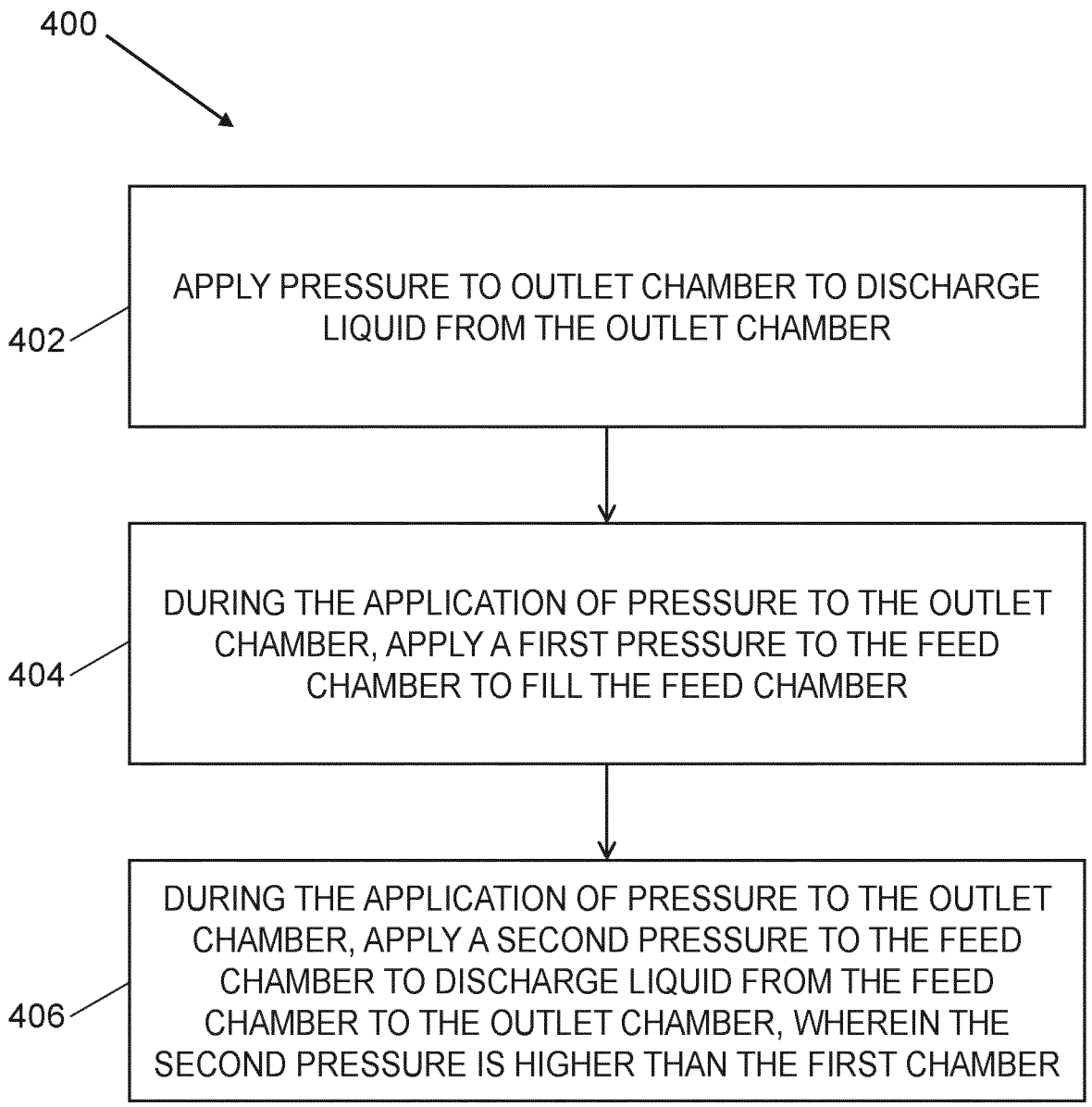
FIG. 4 is a flowchart of a method of operating a fluid actuated pump.

The control system 220 is configured to control the supply of the control fluid according to the method 400 of FIG. 4. In order to implement the method 400, the control system 220 may carry out the following sequence of operations. The following sequence of operations are carried out while applying a negative pressure via the fifth control fluid supply conduit 160*e* to open the third diaphragm valve 150*e* and applying a positive pressure to the diaphragm 174 via the fourth control fluid supply conduit 160*d*, thereby driving liquid out of the outlet chamber 122 and through the liquid outlet 126. At step 1 of the sequence below, it is assumed that the feed chamber 120 is empty and the outlet chamber 122 is partially full (e.g. 50% full).

1. Apply a positive pressure via the third control fluid supply conduit 160*c* to close the second diaphragm valve 150*b*, while applying a negative pressure via the first control fluid supply conduit 160*a* to open the first diaphragm valve 150*a*.

2. Apply a negative pressure to the diaphragm 172 of the feed chamber 120 via the second control fluid supply conduit 160*b*, to aspirate liquid into the feed chamber 120 through the liquid inlet 124.

3. Once the feed chamber 120 is full or has reached a predetermined level (e.g. above 90% full), apply a positive pressure via the first control fluid supply conduit 160*a* to close the first diaphragm valve 150*a*, while applying a negative pressure via the third control fluid supply conduit 160*c* to open the second diaphragm valve 150*b*.

4. Apply a positive pressure to the diaphragm 172 of the feed chamber 120 via the second control fluid supply conduit 160*b*, to discharge liquid from the feed chamber 120 to the outlet chamber 122.

5. Once the feed chamber 120 is empty or has reached a predetermined level (e.g. below 10% full), return to step 1.

The operations above may be modified depending on the configuration of the diaphragm valves 150. For example, if the diaphragms of the diaphragm valves 150 are in contact with the valve seats 152 when the pump 100 is at rest, then no positive pressure may be needed in order to close the diaphragm valves 150. Likewise, if the diaphragms of the diaphragm valves 150 are not in contact with the valve seats 152 when the pump 100 is at rest, then no negative pressure may be needed in order to open the diaphragm valves 150. However, applying a positive or negative pressure may ensure that the diaphragm valves 150 function as intended (i.e. remain open or closed when intended).

Similarly, a negative pressure may not be required at step 2 of the sequence, if the pressure of the liquid upstream of the liquid inlet 124 is sufficiently high to cause filling of the feed chamber 120 within the required filling time interval. Whether or not a negative pressure is required in order to fill the feed chamber 120 may also depend on whether the volume of the outlet chamber 122 is gradually increasing or diminishing (as described further below).

It is beneficial for the diaphragm 174 to be positioned so that the volume of the outlet chamber 122 is approximately 50%. Maintaining this volume of the outlet chamber 122 reduces the risks of (i) the outlet chamber 122 running empty during filling of the feed chamber 120, and (ii) the outlet chamber 122 reaching 100% volume during discharge of the feed chamber 120. Ideally, the volume of the outlet chamber 122 would be slightly under 50% immediately prior to discharge of the feed chamber 120, and slightly over 50% immediately after discharge of the feed chamber 120.

The position of the diaphragm 174 can be detected using the sensor 230 or sensing means, or determined using the means for calculating one or more positions of the diaphragm 174, in order to establish whether the outlet chamber 122 is gradually emptying or gradually filling. In response, the controller 220 can adjust the pressures applied to the diaphragm 172 of the feed chamber 120 in order to adjust the volume of the outlet chamber 122. For example, the positive pressure applied to the diaphragm 172 may be increased in order to reduce the discharge time of the feed chamber 120 (and thereby increase the net flow rate into the outlet chamber 122), if the sensor 230 detects that the outlet chamber 122 is gradually emptying. Similarly, the positive pressure applied to the diaphragm 172 may be reduced in order to increase the discharge time of the feed chamber 120 (and thereby reduce the net flow rate into the outlet chamber 122), if the sensor 230 detects that the outlet chamber 122 is gradually filling. The negative pressure applied to the diaphragm 172 during filling of the feed chamber 120 may, alternatively or additionally, be adjusted. A feedback loop can be employed in order to ensure that the volume of the outlet chamber 122 is kept at the desired level (e.g. approximately 50%).

Figure 6:
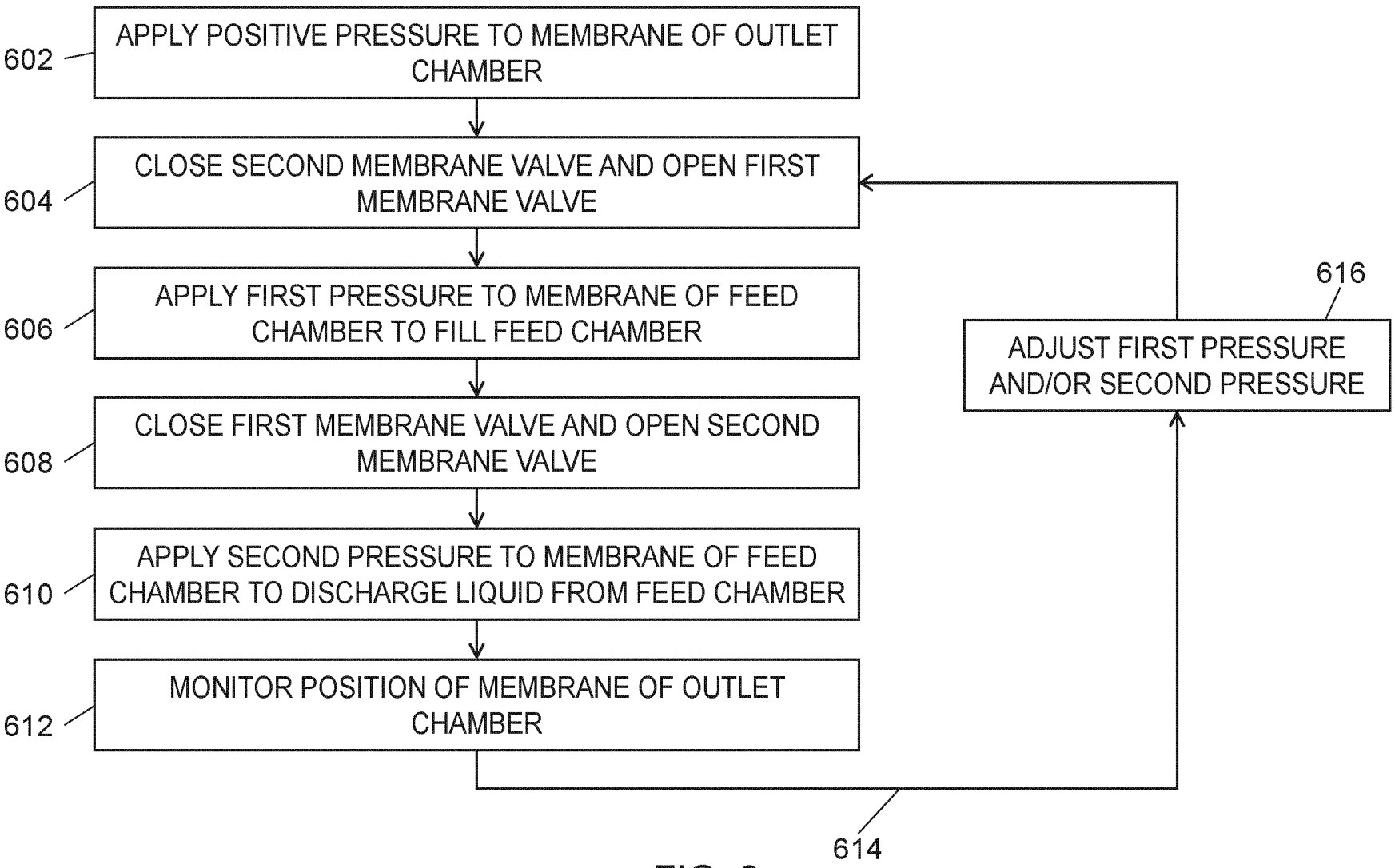
FIG. 6 is a flowchart of a method implemented by the system of FIG. 5.

FIG. 6 is a flowchart of a method 600 of controlling the operation of a fluid actuated pump as described herein (e.g. the pump 100 of FIGS. 1 to 3). The method 600 may, for example, be implemented using one or more processors of the control system 220 shown in FIG. 5. In particular, the method 600 may be implemented upon execution, by the one or more processors, of processor-executable instructions stored on a transitory or non-transitory computer-readable medium (as described below), wherein the execution of the instructions by the one or more processors causes the control system 220 to implement the method 600.

At 602, a positive pressure is applied to the diaphragm 174 of the outlet chamber 122 of the pump 100, to drive liquid out of the outlet chamber 122 and through the liquid outlet 126.

At 604, the second diaphragm valve 150*b* is closed and the first diaphragm valve 150*a* is opened.

At 606, a first pressure (e.g. a negative pressure) is applied to the diaphragm 172 of the feed chamber 120, to draw liquid into the feed chamber 120 through the liquid inlet 124.

At 608, once the feed chamber 120 is full (or exceeds a predetermined level), the first diaphragm valve 150*a* is closed and the second diaphragm valve 150*b* is opened.

At 610, a positive pressure is applied to the diaphragm 172 of the feed chamber 120, to discharge liquid from the feed chamber 120 to the outlet chamber 122.

Optionally, at 612, the position of the diaphragm 174 is monitored (e.g. using the sensor 230 of the control system 200 described above, or an alternative sensing means as described above), in order to determine the volume of the outlet chamber 122.

At 614, once the feed chamber 120 is empty (or is less than a predetermined level), the method returns to 604 until all of the sample volume has been processed.

If it is determined at 612 that the volume of the outlet chamber 122 is too low, then the pressure applied at 606 and/or 610 is adjusted at 616 in order to increase the net flow rate into the outlet chamber 122. On the other hand, if it is determined at 612 that the volume of the outlet chamber 122 is too low, then the pressure applied at 606 and/or 8 610 is adjusted at 616 in order to reduce the net flow rate into the outlet chamber 122.

The following constraints help achieve continuous flow over the sample volume being processed using the pump 100.

The first constraint is that the volume of the feed chamber 120 should be discharged from the outlet chamber 122 during one complete cycle (i.e. discharge and refill) of the feed chamber 120. In an example with a 75 $mm^3$ (75 μL) feed chamber 120 and a 300 $mm^3$ (300 μL) outlet chamber 122, 75 μL should be discharged from the outlet chamber 122 during one cycle (discharge and refill) of the feed chamber 122. If a greater volume is discharged from the outlet chamber 122 during one cycle of the feed chamber 120, then the liquid volume within the outlet chamber 122 will diminish. If the liquid volume within the outlet chamber 122 is allowed to diminish too much, then the outlet chamber 122 will eventually empty, causing interruption to the liquid flow through the outlet 126. Similarly, if a lower volume is discharged from the outlet chamber 122 during one cycle of the feed chamber 120, then the liquid volume within the outlet chamber 122 will accumulate. If the liquid volume within the outlet chamber 122 is allowed to accumulate too much, then the outlet chamber 122 will eventually reach its maximum volume, at which the diaphragm 174 is in contact with the cavity 144 in the second part 140. When this occurs, pressure is applied to the liquid in the outlet chamber 122 via the outlet chamber inlet conduit 130*d*, and not via the diaphragm 174. This causes the flow rate of liquid out of the outlet chamber 122 to increase, which may cause adverse consequences if the flow rate is increased beyond a target flow rate for downstream components.

Assuming instantaneous opening and closing of the diaphragm valves 150 between filling and discharging the feed chamber 120, the first constraint can be expressed as:

$$V_A/F_{in} + V_A/F_{AB} = V_A/F_{out} \quad \text{(Equation 1)}$$

Where:

$V_A$ is the volume of the feed chamber 120;

$F_{in}$ is the flow rate of liquid through the inlet 124 during filling of the feed chamber 120;

$F_{out}$ is the flow rate of liquid through the outlet 126;

$F_{AB}$ is the flow rate between the feed chamber 120 and the outlet chamber 122; and $T_{AB}$ is the time taken to discharge the feed chamber 120.

Solving Equation 1 for $F_{out}$ gives:

$$F_{out} = F_{in} \cdot F_{AB}/(F_{AB} + F_{in}) \quad \text{(Equation 2)}$$

The second constraint is that the net flow rate into the outlet chamber 122 should not cause the volume of the outlet chamber 122 to be exceeded. This can be controlled by controlling the pressure applied to the feed chamber 120. In an example with a 300 μL feed chamber 120 and a 300 μL outlet chamber 122 with an outlet flow of 50 μL/s, where the outlet chamber 122 is fed by the feed chamber 120 when the volume reaches 150 μL, the flow rate into the outlet chamber 122 should not exceed 100 μL/s. This is because a flow rate of 100 μL/s results in a net flow into the outlet chamber 122 of 50 μL/s, and an emptying time for the feed chamber 120 of 3 seconds. With a net inflow of 50 μL/s and a starting volume of 150 μL, the outlet chamber 122 reaches maximum capacity (300 μL) after 3 seconds. Accordingly, the flow rate into the outlet chamber 122 should not exceed 100 μL/s, in order to avoid contact between the diaphragm 174 and the second cavity 144, which causes an increase in outlet flow rate for the reasons discussed above.

The second constraint can be expressed as:

$$V_B + T_{AB} \cdot (F_{AB} - F_{out}) \leq V_{B,max} \quad \text{(Equation 3)}$$

Where:

$V_B$ is the volume of the outlet chamber 122 immediately prior to opening the second diaphragm valve 150*b* (i.e. immediately prior to discharge of the feed chamber 120);

$V_{B,max}$ is the maximum volume of the outlet chamber 122;

$F_{out}$ is the flow rate of liquid through the outlet 126;

$F_{AB}$ is the flow rate between the feed chamber 120 and the outlet chamber 122; and $T_{AB}$ is the time taken to discharge the feed chamber 120.

The time taken to discharge the feed chamber 120 can be expressed as $T_{AB}=V_A/F_{AB}$, where $V_A$ is the volume of the feed chamber 120. Substituting this in Equation 3 and solving for $F_{AB}$ gives the following constraint:

$$F_{AB} \leq (V_A \cdot F_{out})/(V_B + V_A - V_{B,max}) \quad \text{(Equation 4)}$$

In operation, pressure is applied to the diaphragms 172 and 174 of the feed and outlet chambers 120, 122. The pressures applied to these diaphragms 172, 174 determine the flow rates $F_{in}$, $F_{AB}$ and $F_{out}$ in Equations 2 and 4. Therefore, the pressures applied to the diaphragms 172, 174 can be controlled (e.g. by the control system 220) in order to ensure that the above constraints are met. It will be appreciated that the pressure applied to the liquid in the feed chamber 120 must be higher than the pressure applied to the liquid in the outlet chamber 122, otherwise liquid would not be fed into the outlet chamber 122 from the feed chamber 120.

Equation 2 assumes that the diaphragm valves 150*a*, 150*b* are instantaneously opened and closed, meaning that there is no down-time between filling of the feed chamber 120 and discharge of the feed chamber 122. In practice, however, there is a finite time interval between filling of the feed chamber 120 being completed, and discharge of the feed chamber 120 being started. This finite time has an increased impact at shorter filling and discharge cycles of the feed chamber 120. For this reason, it is preferable for the cycle time of the feed chamber 120 to be at least one second (in other words, a cycle frequency of ≤1 Hz).

A typical operating pressure for biopharmaceutical processing is in range of 0-10 barg, and preferably in range of 0-5 barg. A typical operating pressure for the pump according to the invention, and thus liquid pressure at the outlet chamber, is in range of 0-10 barg and preferably in range of 0-5 barg. A typical liquid flow rate at the outlet of the pump according to the invention is in range of 0.001-1000 ml/min and preferably in range of 0.01-200 ml/min.

Figure 7:
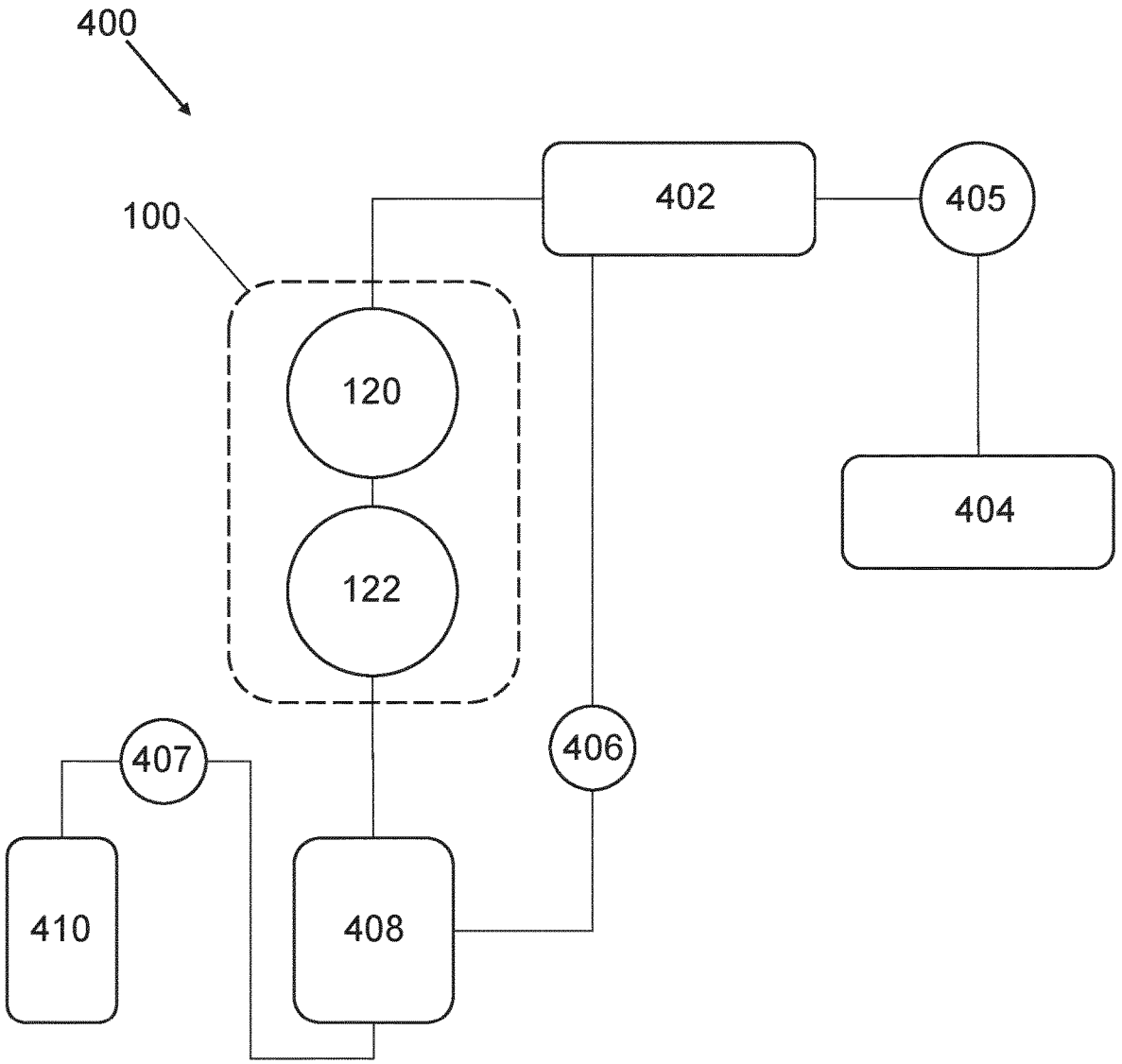
FIG. 7 is a schematic diagram of a tangential flow filtration system comprising a fluid actuated pump.

FIG. 7 is a schematic diagram of a tangential flow filtration (TFF) system 400 comprising the fluid actuated pump 100. The diaphragm valves 150 of the fluid actuated pump 100 are not shown in FIG. 7. In the system 400, the feed chamber 120 receives liquid from a TFF reservoir 402 and/or a diafiltration buffer reservoir 404 in fluidic communication with a diafiltration pump 405. Diafiltration pump 405 is shown with only one single pump chamber (the valves and inlet and outlet of the chamber are not shown) as its task is to dispense a desired liquid volume into the TFF reservoir 402 without the requirement of continuous pulsation free liquid flow. The TFF system 400 further includes optional pressure control valves (PCVs) 406 and 407. The purpose of the pressure control valves 406, 407 is to throttle the liquid flow to increase the liquid pressure upstream of the valve. Therefore, pressure conditions at a TFF filter 408 can be modulated to achieve desired operating conditions in terms of pressure and to control the effective transmembrane pressure (TMP). The feed chamber 120 is connected in series with the outlet chamber 122. The outlet chamber 122 provides a liquid outlet to the TFF filter 408. The retentate liquid from the TFF filter 408 is recirculated via optional PCV 406 back to the TFF reservoir 402 where it can be mixed with diafiltration buffer supplied to the TFF reservoir 402 via pump chamber 405. The filtrate from the TFF filter 408 is passed to a waste chamber 410, and optional PCV 407 may modulate the filtrate pressure to a level above ambient pressure. The fluid actuated pump 100 therefore provides continuous and pulsation-free liquid flow over the TFF filter 408, ensuring that the membrane of the TFF filter 408 will run at constant operating conditions in terms of flow rate and pressure to achieve maximum performance, does not become fouled, and that efficient separation of the retentate and filtrate is achieved.

Figure 8:
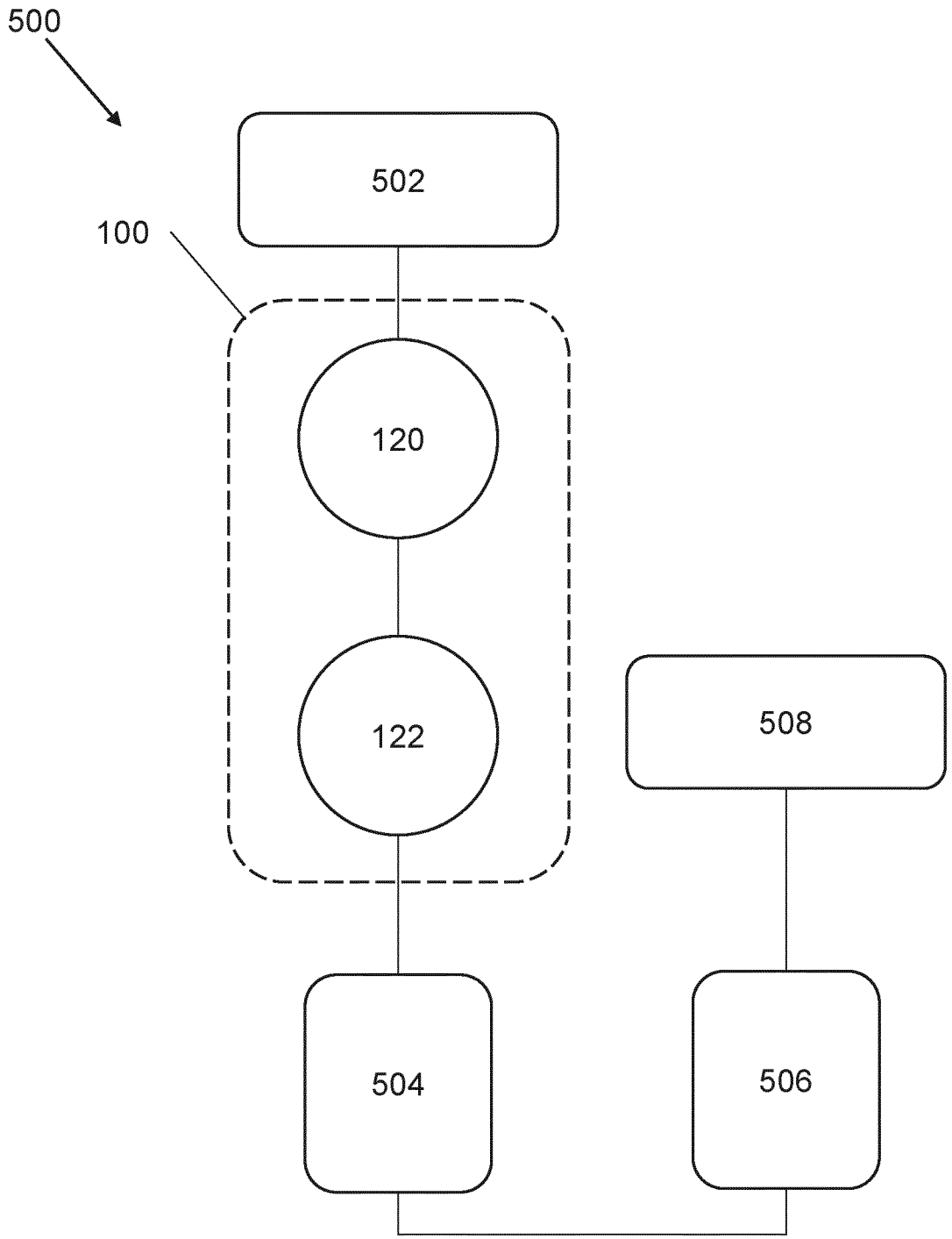
FIG. 8 is a schematic diagram of a chromatography system comprising a fluid actuated pump.

FIG. 8 is a schematic diagram of a chromatography system 500 comprising the fluid actuated pump 100. Again, the diaphragm valves 150 of the fluid actuated pump 100 are not shown in FIG. 8. In the system 500, the feed chamber 120 receives liquid from an inlet container 502. Typically, an inlet manifold and associated valves would allow for direction of serval different inlet liquids to the system and the chromatography column; however, these are not shown in FIG. 8. The feed chamber 120 is connected in series with the outlet chamber 122. The outlet chamber 122 provides a liquid outlet to a chromatography column 504. Once liquid has passed through the chromatography column 504, it passes through various sensing devices schematically illustrated at 506, including pressure, UV, conductivity, and/or pH sensors upstream of an outlet manifold and respective outlet pathways, not shown in FIG. 8, the sensor signals allowing the control system to select outlet valves and direct the liquid fractions to product or waste outlets, for example, outlets and an outlet manifold being illustrated schematically at 508.

The fluid actuated pump 100 therefore provides continuous liquid flow over chromatography column 504, ensuring accurate separation of different effluent fractions to collect the drug substance of interest with desired purity and yield.

Figure 9:
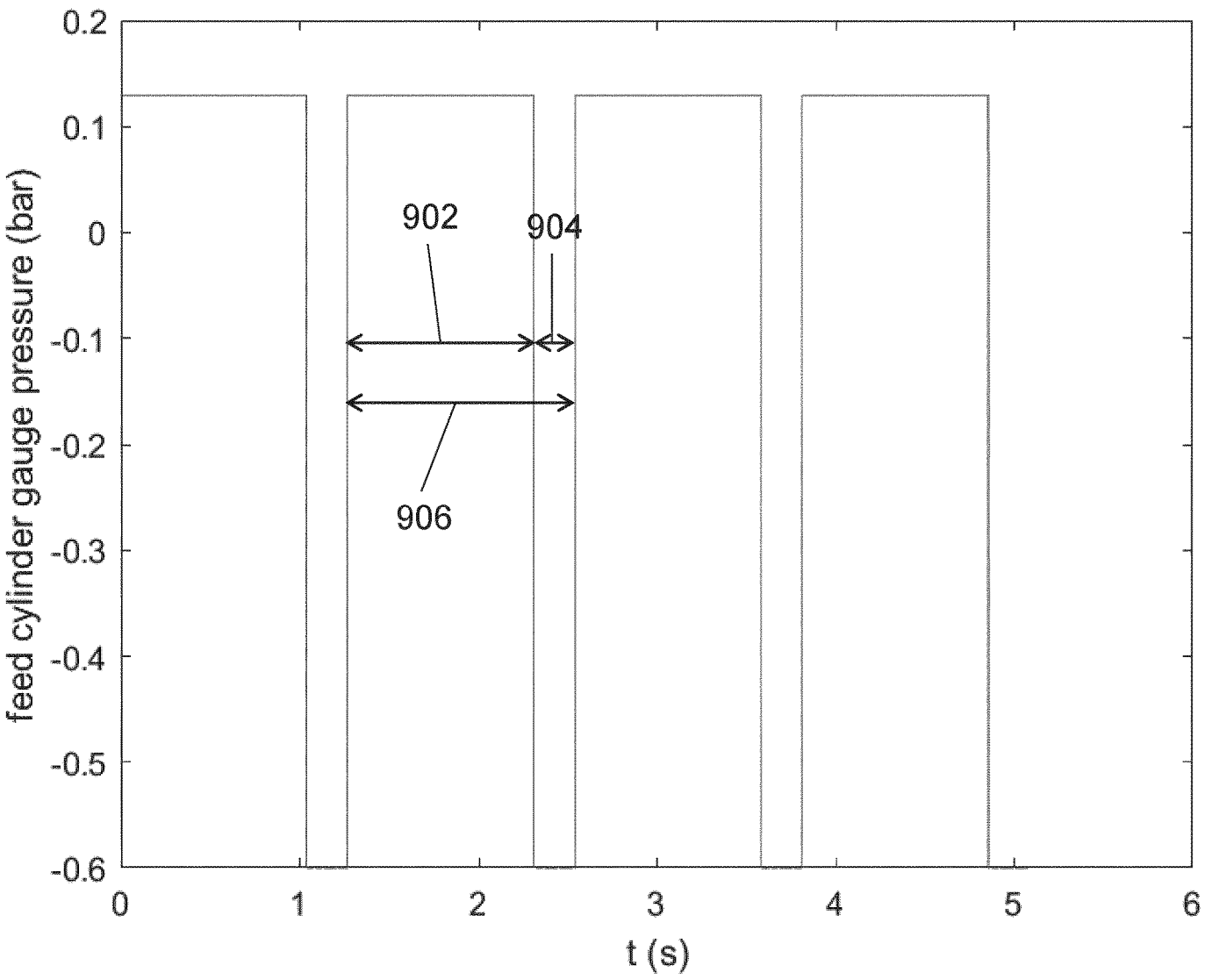
FIG. 9 is a graph showing the pressure applied to a feed chamber of a fluid actuated pump over time according to a first example.
Figure 10:
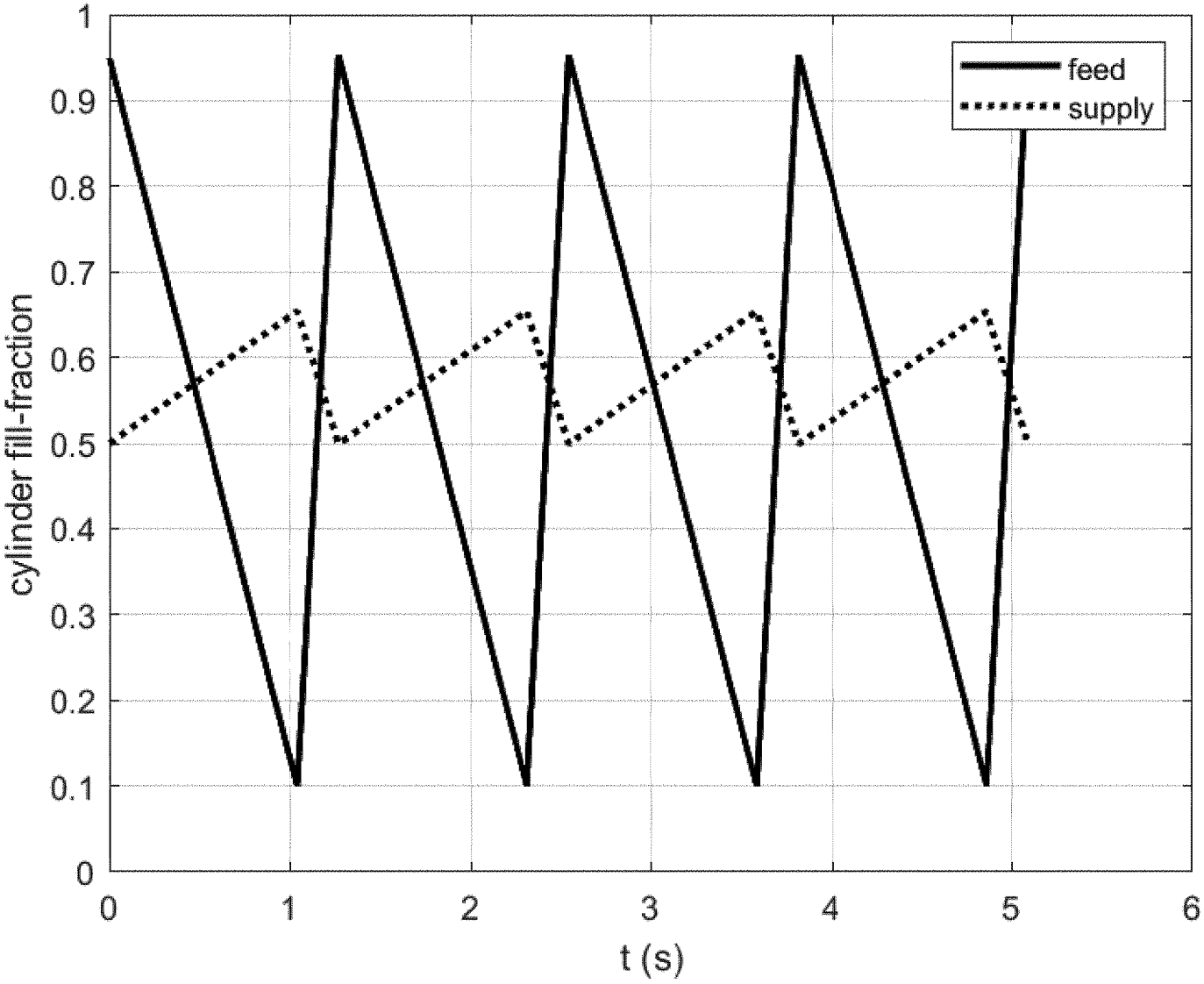
FIG. 10 is a graph showing the fill fraction of chambers of a fluid actuated pump over time according to the first example.

FIG. 9 is a graph showing the pressure applied to a diaphragm (e.g. diaphragm 172) of a feed chamber (e.g. feed chamber 120) over time, according to a first example. FIG. 10 is a graph showing the fill fraction of chambers (e.g. chambers 120, 122) of a fluid actuated pump (e.g. pump 100) over time, according to the same example.

In the first example, the chambers 120, 122 were modelled as cylinders. Specifically, the feed chamber 120 was modelled as a 10 mm diameter cylinder, with a depth of 1 mm, while the outlet chamber 122 was modelled as a 20 mm diameter cylinder, with a depth of 1 mm. The diameter of conduits 130*a*-130*d* was modelled as 1.5 mm, while the diameter of conduits 130*e*, 130*f* was modelled as 1 mm. The minimum pressure applied to the diaphragm 172 of the feed chamber 120 was −10 kPa (i.e. via a vacuum line), while the pressure applied to the diaphragm 172 of the feed chamber 120 during filling of the feed chamber 120 was slightly more than 10 kPa. The pressure applied to the diaphragm 174 of the outlet chamber 122 was 10 kPa. The discharge coefficient of the liquid inlet 124 and conduits 130*a*-130*b* was modelled as 1, while the discharge coefficient of conduits 130*c*-130*d* was also modelled as 1, and the discharge coefficient of conduits 130*e*-130*f* and liquid outlet 126 was modelled as 0.6.

As seen from FIG. 9, the pressure applied to the diaphragm 172 of the feed chamber 120 was −0.1 bar during filling of the feed chamber 120, and just over 0.1 bar during discharge of the feed chamber 120. As seen from FIG. 9, the filling phase (indicated using arrow 904 in FIG. 9) was modelled as being approximately half of the duration of the discharge phase (indicated using arrow 902 in FIG. 9). FIG. 9 also indicates the cycle time, using arrow 906.

The pressures shown in FIG. 9 resulted in the fill fractions indicated in FIG. 10. In particular, the fill fraction of the feed chamber 120 varies between just over 0 (i.e. approximately 0.1) and just under 1 (i.e. approximately 0.95). In contrast, the fill fraction of the outlet chamber 122 stays between approximately 0.5 and approximately 0.65.

The fluid actuated pump 100 and associated controller 220 provide several advantages over existing single-use pump components. In particular, the design of the fluid actuated pump 100 provides low shear forces by active control of inlet and outlet valves to the pump chambers. These shear forces are low compared to the passive check-valves typically applied in conventional pumps that cause liquid throttling (restriction) due to their design, thereby requiring a certain liquid pressure to overcome a predetermined valve closing force (and respective closing pressure). Providing low shear forces is especially important for sensitive drug substances, products and/or formulations to avoid mechanically destroying molecules. A cycle frequency of ≤1 Hz also minimises the shear forces on the liquid. In addition, the fluid actuated pump 100 allows for substantially continuous liquid output, with low pulsations (i.e. less than 10% variation in outlet flow rate) observed in experimental testing. The pulsations observed by using the fluid actuated pump 100 are significantly lower compared to a single chamber pneumatically driven pump that would supply liquid intermittently.

If the fluid actuated pump 100 incorporates the third diaphragm valve 150*c*, then it provides the functional advantage of allowing for bi-directional flow control (i.e. forward or backward pumping). Bi-directional flow can be controlled more easily by implementing a feed chamber 120 and an outlet chamber 122 that are the same size.

Further, the design of the fluid actuated pump 100 is very simple, with only three main parts (i.e. first part 110, second part 140, and diaphragm 170). The simple design of the pump 100 provides increased ease of production and assembly over existing solutions. Moreover, the simple design allows for production at low cost and in high volumes.

In addition, as the diaphragms 172, 174 are actuated using a control fluid such as air, a standard control system (e.g. control system 220) can be used to control pumping operations according to a wide variation in pump configurations. For example, the pump 100 described above may be modified to include additional chambers and/or valves in order to provide a more complex liquid flow arrangement (e.g. utilising multiple feed chambers to provide for a range of outlet flow rates by selection of a subset of the multiple feed chambers, as described above). This more complex arrangement could be controlled in the same way as the pump 100 described above, because the only interfaces on the pump are for the supply of a control fluid such as air, and a liquid inlet and outlet. Accordingly, a number of variations of pump configuration are operable using a standard control fluid supply system.

Variations or modifications to the systems and methods described herein are set out in the following paragraphs.

Although the fluid actuated pump 100 shown in FIGS. 1 to 3 includes diaphragm valves 150, alternative valves may be used to control fluid flow into and out of the chambers 120, 122. In particular, the diaphragm valves 150 are described by way of example only, and other types of actuatable valve may be used instead of the diaphragm valves 150. For example, the valves may be pressure control valves that only allow liquid flow in excess of a specific pressure.

The pressure downstream of the outlet chamber 122 affects the control of the fluid actuated pump 100. For example, if there is a downstream pressure of 2 bar when running a chromatography column at a particular flow rate, then increasing the flow rate by a factor of two will result in a downstream pressure of 4 bar approximately. The pressures applied to the chambers 120, 122 of the pump 100 would therefore need to be adjusted to compensate for the increased downstream pressure.

Having a pressure control valve (PCV) at the outlet from the second chamber 122 (or downstream of the second chamber 122) allows the outlet flow from the fluid actuated pump to be throttled and to provide a particular outlet pressure at the liquid outlet 126. Continuing the above example, a PCV can be used to provide a minimum outlet pressure from the pump of 4 bar. When the chromatography column results in a pressure drop of 4 bar, the PCV is opened, and when the chromatography column results in a lower pressure drop (i.e. at lower flow rate), the PCV can be closed partially so that the sum of the pressure loss over the PCV and the chromatography column is 4 bar.

As a further example, the valves may be one-way valves (e.g. passive non-return valves) that do not require actuation by a control system, in which case the control system only applies pressures to the diaphragms 172, 174 of the chambers 120, 122. As one specific example, passive non-return valves may be implemented for a fluid actuated pump that is used for one-way liquid flow (i.e. non-reversible), by using solid silicone flaps within the liquid supply conduits. The silicone flaps would be pushed apart by the liquid flow in the intended direction, but would prevent liquid flow in the reverse direction. In this way, three control fluid supply lines (i.e. used for actuating the diaphragm valves) could be removed from the pump, thereby simplifying its construction.

Figure 11:
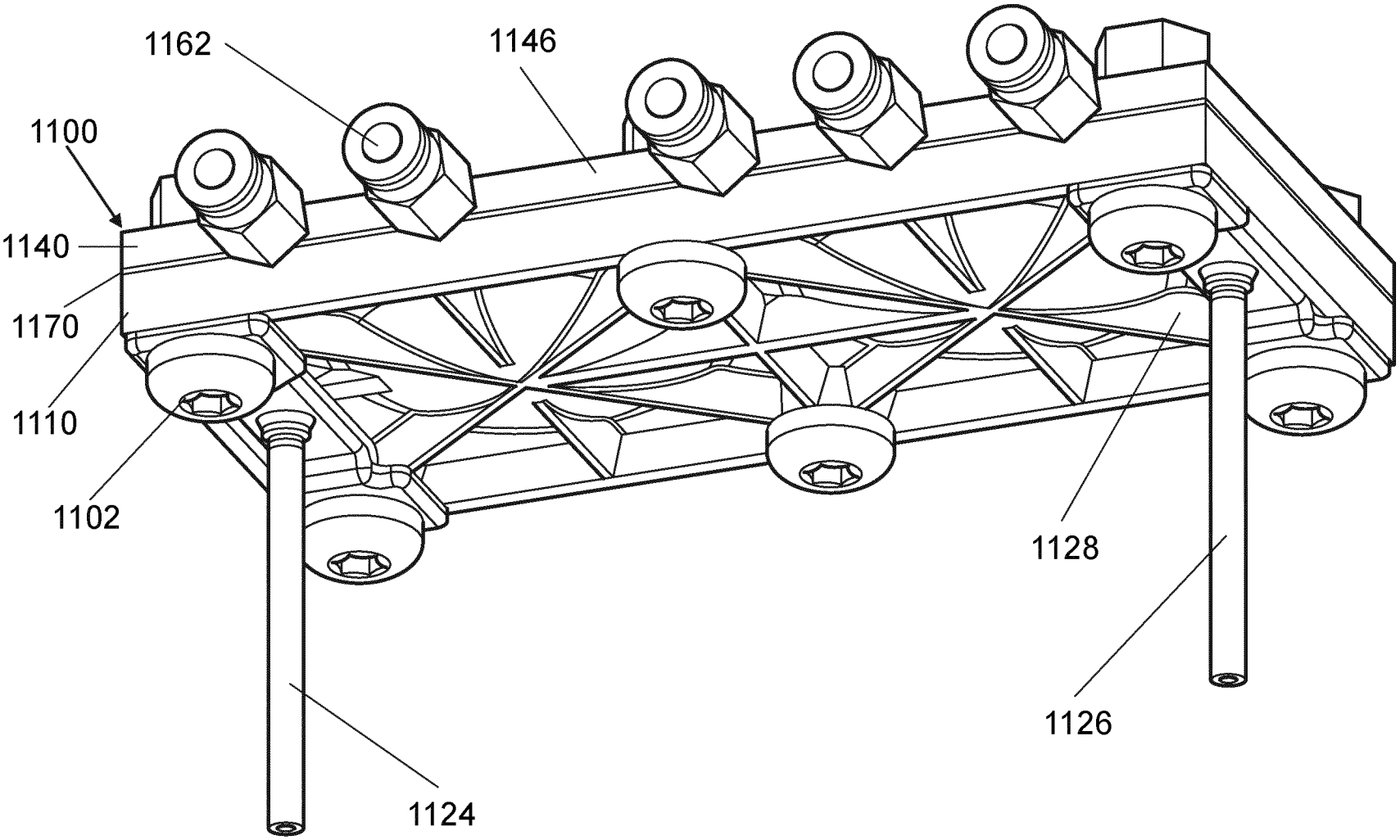
FIG. 11 is a lower perspective view of a fluid actuated pump according to a second embodiment.

FIG. 11 is a perspective view of a fluid actuated pump 1100 according to a second embodiment. As with the fluid actuated pump 100 of the first embodiment, the fluid actuated pump 1100 includes a first part 1110, a second part 1140, and a diaphragm 1170 sandwiched between the first part 1110 and the second part 1140, using fixings 1102.

Figure 12:
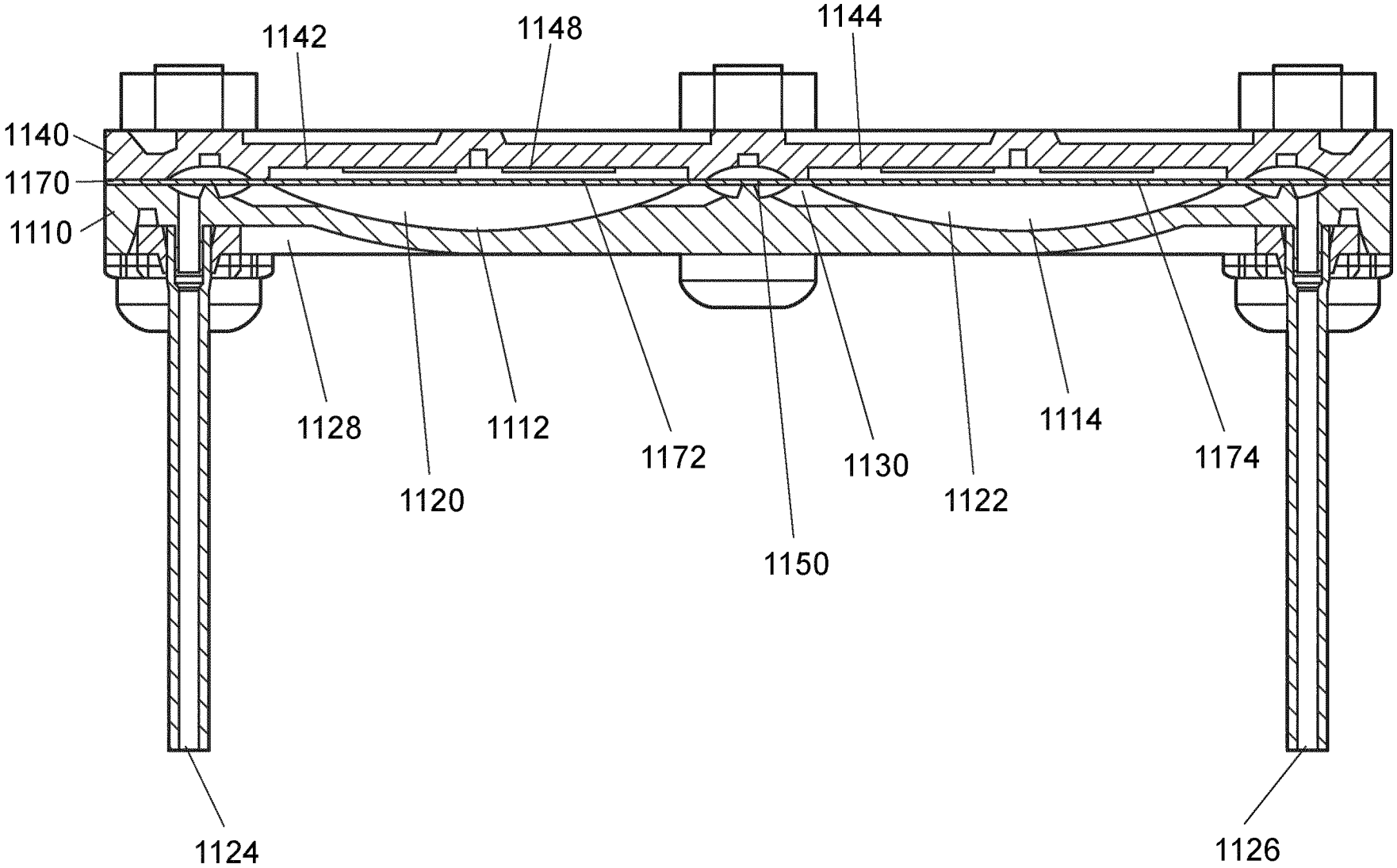
FIG. 12 is a side section view through the fluid actuated pump shown in FIG. 11.
Figure 13:
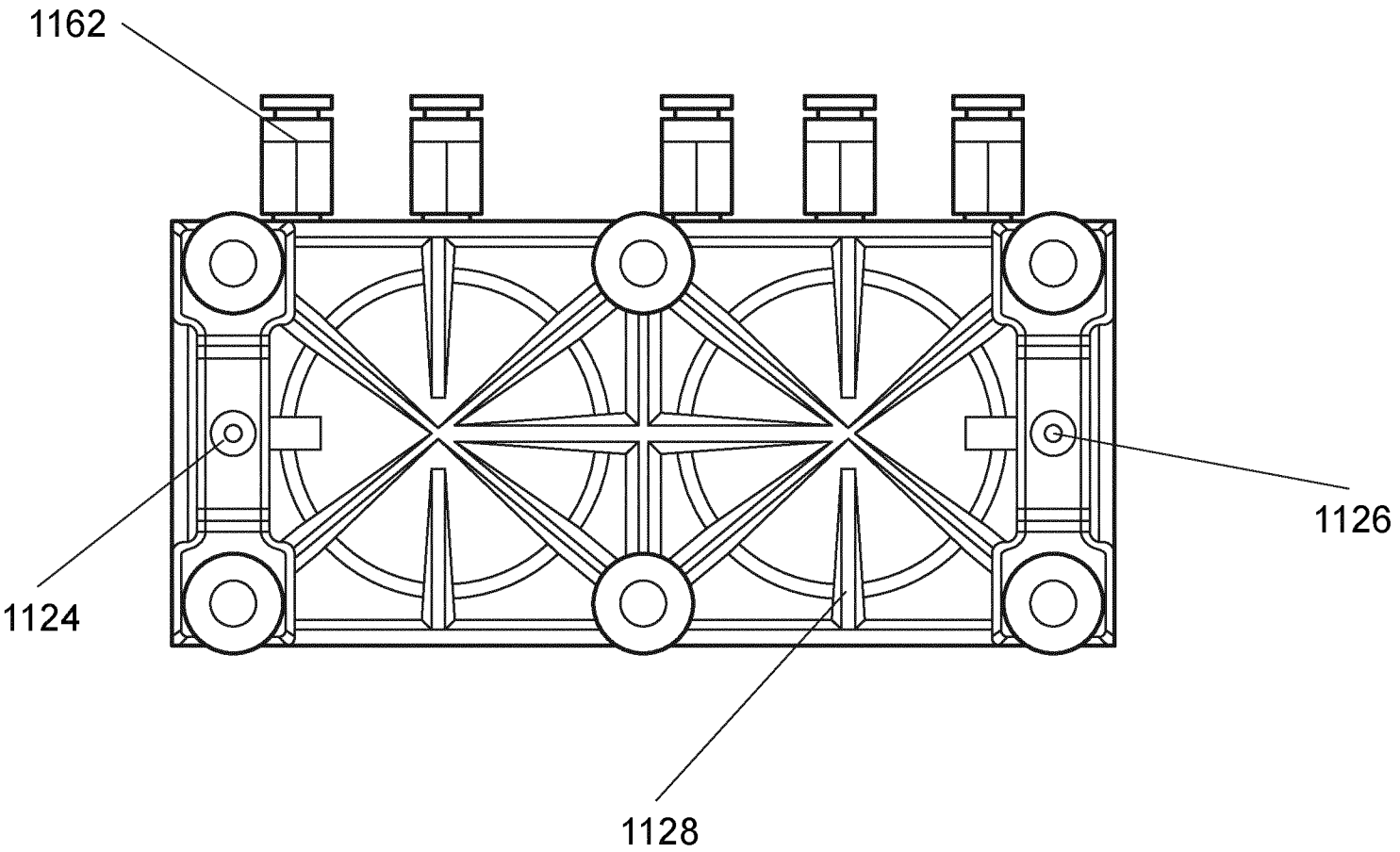
FIG. 13 is a bottom view of the fluid actuated pump shown in FIG. 11.

As best shown in FIG. 12, the first part 1110 includes two concave cavities 1112, 1114. The first part 1100 also includes webs 1128 (best shown in FIGS. 11 and 13) on the exterior of the first part 1100, that support the concave shape of the cavities 1112, 1114 and allow the first part 1100 to be produced (e.g. by injection moulding) using less material than the first part 110 of the fluid actuated pump 100 of the first embodiment. Unlike the fluid actuated pump 100 of the first embodiment, however, the second part 1140 includes two shallow cylindrical cavities 1142, 1144. The cavities 1142, 1144 include a pattern of protrusions 1148 (best shown in FIG. 15) that protrude towards the diaphragm 1170 from the surface of the cavity 1142, 1144 that is parallel to the diaphragm 1170. As shown in FIG. 12, the protrusions 1148 do not contact the diaphragm 1170 when the pump 1100 is at rest.

The portion of the diaphragm 1170 that covers the cavity 1112 is referred to herein as diaphragm 1172. A first chamber (or "feed chamber") 1120 has a volume defined by the diaphragm 1172 and the cavity 1112. The portion of the diaphragm 1170 that covers the cavity 1114 is referred to herein as diaphragm 1174. A second chamber (or "outlet chamber") 1122 has a volume defined by the diaphragm 1174 and the cavity 1114. The second chamber 1122 is connected in series with the first chamber 1120.

The fluid actuated pump 1100 also includes diaphragm valves 1150 that operate in the same manner as diaphragm valves 150 of fluid actuated pump 100.

The fluid actuated pump 1100 includes a liquid inlet 1124 that allows liquid to flow into the fluid actuated pump 1100, and a liquid outlet 1126 that allows liquid to flow out of the fluid actuated pump 1100. Unlike the fluid actuated pump 100 of the first embodiment, the liquid inlet 1124 of the fluid actuated pump 1100 of the second embodiment allows liquid to flow into the pump 1100 in a direction that is perpendicular to the diaphragm 1170. Likewise, the liquid outlet 1126 allows liquid to exit the pump 1100 in a direction that is perpendicular to the diaphragm 1170. It will be appreciated, therefore, that the implementations described herein provide a flexible design architecture in which the liquid inlet and outlet and the control fluid inlets may be located on various surfaces (i.e. sides, faces, ends) of the pump, as shown by the different configurations of the inlets and outlets in the pumps of the first and second embodiments.

Figure 14:
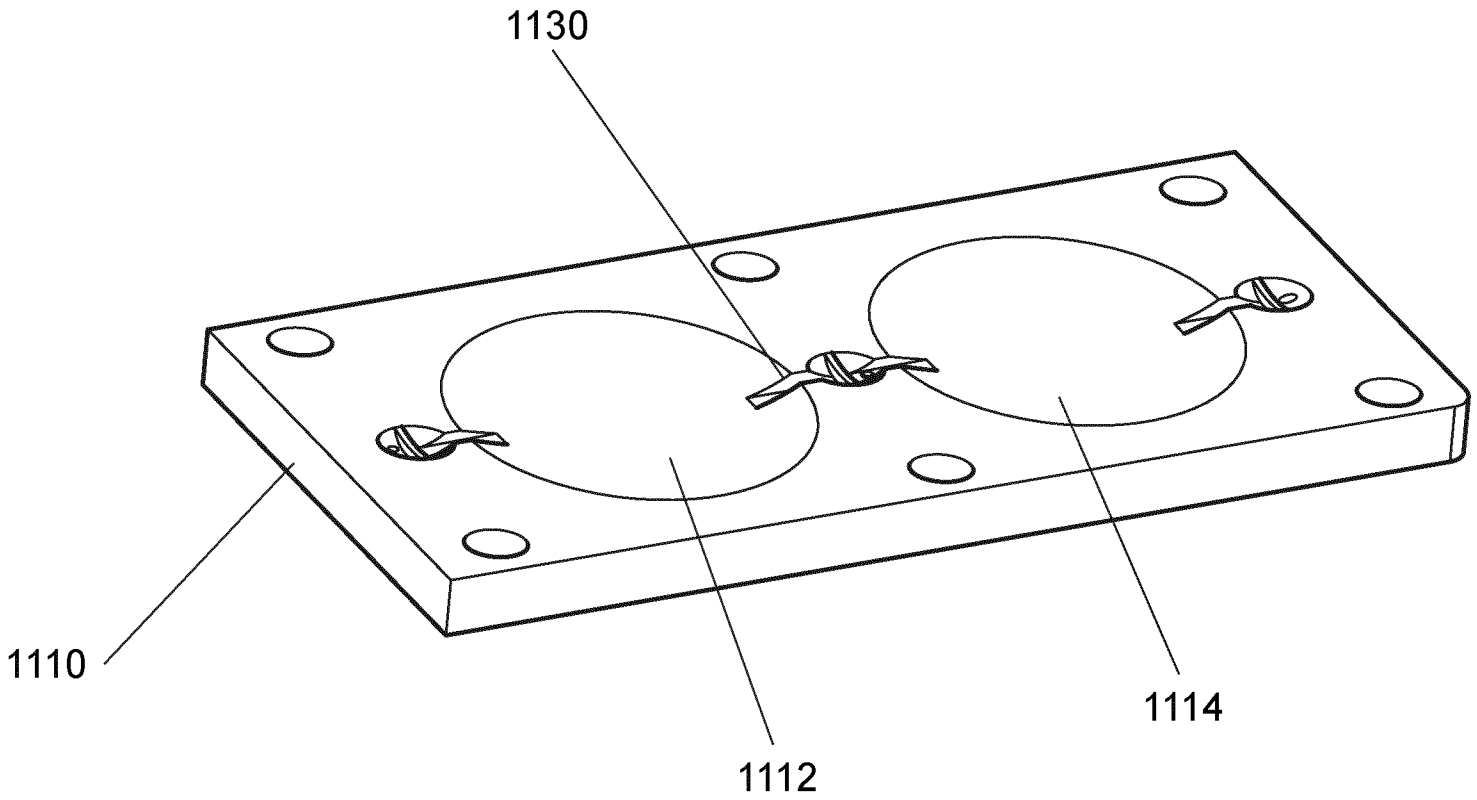
FIG. 14 is a perspective view of a first part of the fluid actuated pump shown in FIG. 11.

As shown in FIGS. 12 and 14, the first part 1110 includes liquid supply conduits 1130 that provide fluidic connections between the diaphragm valves 1150 and the chambers 1120, 1122. Unlike the fluid actuated pump 100 of the first embodiment, the liquid supply conduits 1130 of the fluid actuated pump 1100 are open to the diaphragm 1170 (as best shown in FIG. 14), meaning that the diaphragm 1170 forms a wall of each liquid supply conduit 1130. By providing liquid supply conduits 1130 that are open to the diaphragm 1170 and the interface between diaphragm 1170 and the first part 1110, manufacture of the first part 1110 is simplified, for example by allowing efficient moulding (e.g. injection moulding) of the first part 1110 and providing access for surface modification or machining operations, if desired.

Figure 15:
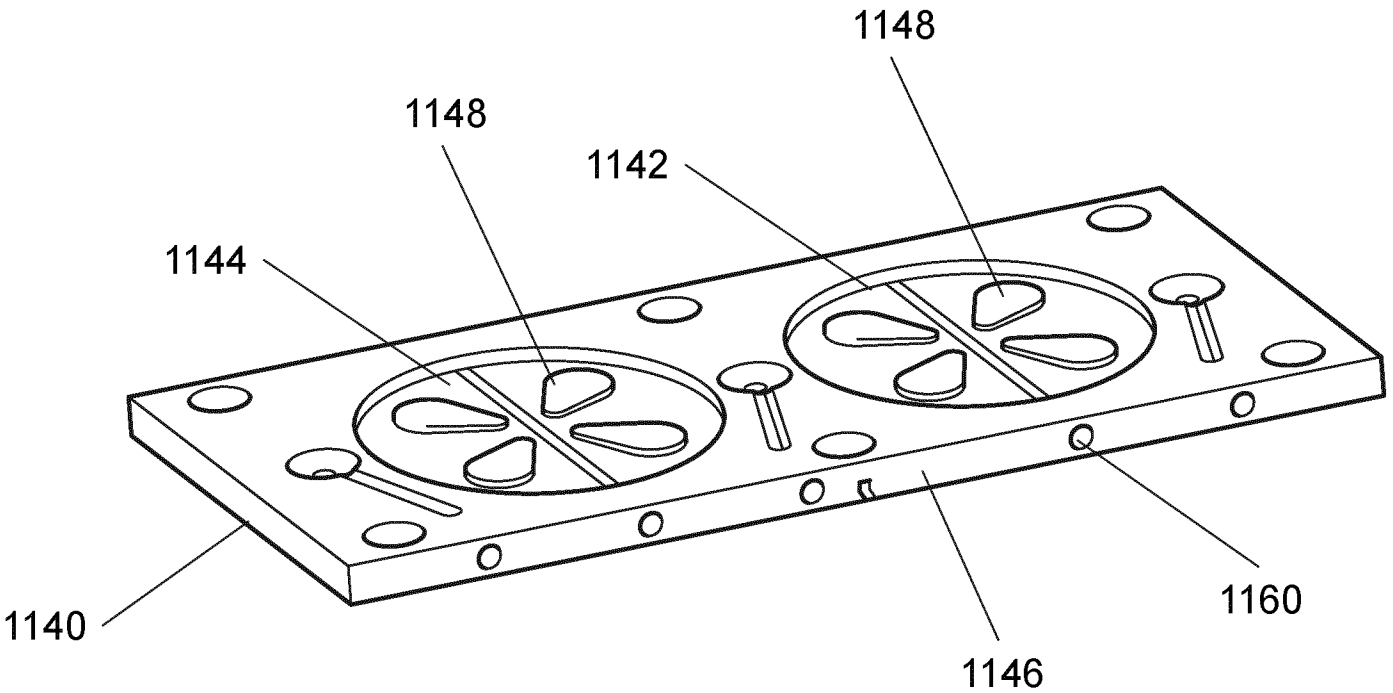
FIG. 15 is a perspective view of a second part of the fluid actuated pump shown in FIG. 11.

As best shown in FIG. 15, the second part 1140 includes fluid supply conduits 1160 that extend between an exterior surface 1146 of the second part 1140 and a respective component (diaphragm valve 1150, cavity 1142, 1144). Unlike the fluid actuated pump 100 of the first embodiment, the fluid supply conduits 1160 of the fluid actuated pump 1100 do not extend perpendicular to the diaphragm 1170, and instead terminate in fluid supply connections 1162 on the side of the pump 1100.

The fluid actuated pump 1100 is operated in the same way as the fluid actuated pump 100 of the first embodiment. Accordingly, methods 400 and 600 are also applicable to operation of the fluid actuated pump 1100. Moreover, the fluid actuated pump 1100 may be implemented in system 200, TFF system 400 and chromatography system 500. The patterns of protrusions 1148 within the cavities 1142, 1144 of the second part 1140 serve to decrease potential sticking effects of the diaphragm 1170 to the internal surfaces of the cavities 1142, 1144 (e.g. for a TPE diaphragm and a COC second part). The patterns of protrusions 1148 also help distribute a gaseous control fluid over the diaphragms 1172, 1174 when such a control fluid is supplied via the fluid supply conduits 1160.

Figure 16:
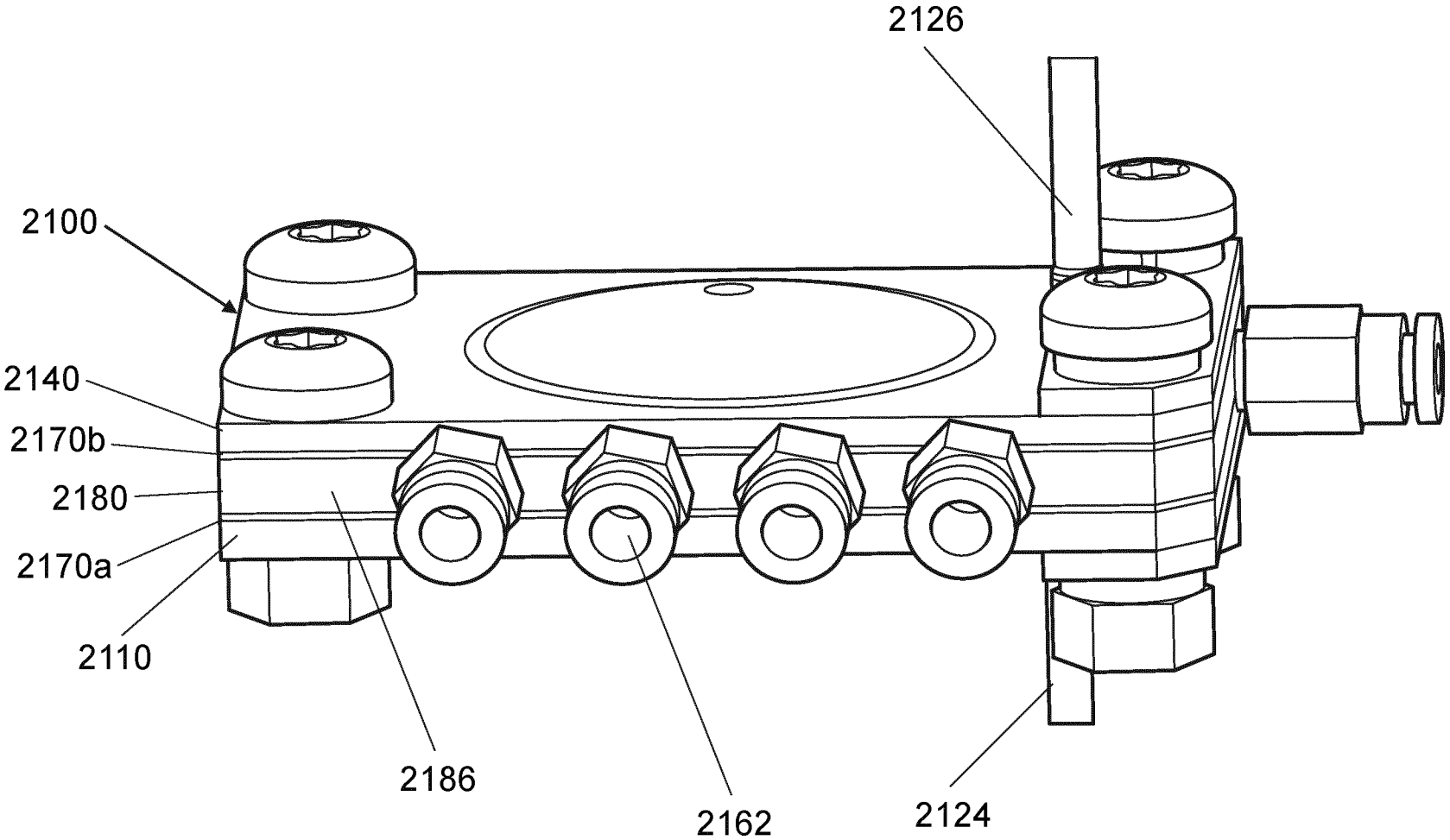
FIG. 16 is a perspective view of a fluid actuated pump according to a third embodiment.

FIG. 16 is a perspective view of a fluid actuated pump 2100 according to a third embodiment. The fluid actuated pump 2100 includes a first part 2110, a second part 2140, and an intermediate part 2180 sandwiched between the first part 2110 and the second part 2140. The fluid actuated pump 2100 also includes two diaphragms: a first diaphragm 2170*a* sandwiched between the first part 2110 and the intermediate part 2180, and a second diaphragm 2170*b* sandwiched between the intermediate part 2180 and the second part 2140.

The fluid actuated pump 2100 includes chambers defined by concave cavities, as with the fluid actuated pump 100 of the first embodiment. Unlike the fluid actuated pump 100 of the first embodiment, however, the chambers are stacked on top of each other. This means that the first part 2110 and the second part 2140 each include a cavity, while the intermediate part 2180 includes two cavities: a first cavity in a first surface of the intermediate part 2180 that contacts the first diaphragm 2170*a*, and a second cavity in a second surface of the intermediate part 2180 that contacts the second diaphragm 2170*b*.

The intermediate part 2180 also includes fluid supply conduits that extend between an exterior surface 2186 of the intermediate part 2180 and a respective component (diaphragm valve, cavity). The fluid supply conduits terminate in fluid supply connections 2162 on the side of the pump 2100. The fluid actuated pump 2100 also includes a liquid inlet 2124 that allows liquid to flow into the pump 2100 in a direction that is perpendicular to the first diaphragm 2170*a*, and a liquid outlet 2126 that allows liquid to flow out of the pump 2100 in a direction that is perpendicular to the second diaphragm 2170*b*. As shown in FIG. 16, the liquid inlet 2124 and the liquid outlet 2126 are provided on opposite sides of the pump 2100, further illustrating the flexible placement of the inlets and outlets that is possible in the pumps described herein.

By providing the chambers of the fluid actuated pump 2100 in a stacked configuration, the fluid actuated pump 2100 can be made more compact.

Although the cavities of the pumps described above are shown as being dome-shaped, (hemispherical chords) other cavity shapes may be implemented in order to maximise liquid drain from the chambers. For example, the cavity shape may be designed to match the shape of a deflected diaphragm that is held at fixed points around the circumference of the cavity. In such a case, the cavity shape would be a bell-shaped curve.

As an alternative to supplying a control fluid to deform the diaphragm, electrically actuated diaphragms may be implemented. As one example, a bimetallic foil may be embedded in a silicone sheet forming the diaphragm covering each of the cavities. Applying a voltage would cause curvature of the bimetallic foil (thereby deforming the diaphragm), meaning that no control fluid would be required. The application of a voltage would allow for fine control and would reduce control fluid supply system lag. In addition, monitoring of the diaphragm position would not be needed, as it would be a function of the applied voltage.

The described methods may be implemented using computer executable instructions. A computer program product or computer readable medium may comprise or store the computer executable instructions. The computer program product or computer readable medium may comprise a hard disk drive, a flash memory, a read-only memory (ROM), a CD, a DVD, a cache, a random-access memory (RAM) and/or any other storage media in which information is stored for any duration (e.g., for extended time periods, permanently, brief instances, for temporarily buffering, and/or for caching of the information). A computer program may comprise the computer executable instructions. The computer readable medium may be a tangible or non-transitory computer readable medium. The term "computer readable" encompasses "machine readable".

The singular terms "a" and "an" should not be taken to mean "one and only one". Rather, they should be taken to mean "at least one" or "one or more" unless stated otherwise. The word "comprising" and its derivatives including "comprises" and "comprise" include each of the stated features, but does not exclude the inclusion of one or more further features.

The above implementations have been described by way of example only, and the described implementations are to be considered in all respects only as illustrative and not restrictive. It will be appreciated that variations of the described implementations may be made without departing from the scope of the invention. It will also be apparent that there are many variations that have not been described, but that fall within the scope of the appended claims.

The invention claimed is:

1. A pump for providing substantially continuous liquid flow in a bioprocessing system, the pump comprising:

a pressurisable outlet chamber in fluidic communication with an outlet of the pump; and a pressurisable feed chamber connected in series with the outlet chamber, wherein the feed chamber is configured to fill the outlet chamber during discharge of liquid from the outlet chamber, and wherein each of the feed chamber and the outlet chamber is pressurisable by deformation of a respective flexible diaphragm of the chamber, wherein each respective flexible diaphragm is deformable by application of a control fluid to the flexible diaphragm.

2. The pump of claim 1, further comprising a valve configured to prevent the flow of liquid from the feed chamber to the outlet chamber during filling of the feed chamber.

3. The pump of claim 1, wherein the feed chamber is in fluidic communication with an inlet of the pump, and wherein the pump further comprises a valve configured to prevent the flow of liquid through the inlet during filling of the outlet chamber.

4. The pump of claim 1, wherein the feed chamber is configured to be filled when a first pressure is applied to the feed chamber, and wherein the feed chamber is configured to fill the outlet chamber when a second pressure is applied to the feed chamber, wherein the second pressure is higher than the first pressure.

5. The pump of claim 1, further comprising a valve between the outlet chamber and the outlet.

6. The pump of claim 1, wherein the outlet chamber and the feed chamber are substantially equal in volume.

7. The pump of claim 1, further comprising a plurality of conduits for enabling the application of the control fluid to the flexible diaphragm of each chamber, wherein each of the plurality of conduits extends substantially perpendicularly to the flexible diaphragm of a respective chamber.

8. The pump of claim 1, wherein each respective flexible diaphragm is provided by the same diaphragm.

9. The pump of claim 8, wherein the diaphragm further provides at least one actuatable portion of one or more valves.

10. The pump of claim 8, wherein the diaphragm is sandwiched between a first part and a second part.

11. The pump of claim 10, wherein the first part and/or the second part comprise: polypropylene (PP), polymethylpentene; and/or cyclic olefin copolymer (COC) materials.

12. The pump of claim 1, wherein the diaphragm is formed of: a polymer material; a fluoropolymer; an elastomer; perfluoroalkoxy copolymer resin thermoplastic material; silicone rubber; EPDM rubber; and/or thermoplastic elastomers (TPE).

13. A bioprocessing system comprising:

the pump of claim 1; and a control system for applying pressure to the chambers of the pump, wherein the control system is configured to:

apply pressure to the outlet chamber of the pump to discharge liquid from the outlet chamber; and during application of the pressure to the outlet chamber:

apply a first pressure to the feed chamber of the pump to fill the feed chamber; and apply a second pressure to the feed chamber to discharge liquid from the feed chamber to the outlet chamber, wherein the second pressure is higher than the first pressure.

14. A method of operating the pump of claim 1, the method comprising:

applying pressure to the outlet chamber of the pump to discharge liquid from the outlet chamber;

during the application of pressure to the outlet chamber, applying a first pressure to the feed chamber of the pump to fill the feed chamber; and during the application of pressure to the outlet chamber, applying a second pressure to the feed chamber to discharge liquid from the feed chamber, wherein the second pressure is higher than the first pressure.

15. The pump of claim 1, wherein the diaphragm comprises a thermoplastic elastomer (TPE), said TPE comprising:

at least one elastomeric material; and at least one thermoplastic material having a glass transition temperature (Tg) from about 65 to about 95° C.

16. The pump of claim 15, wherein the at least one elastomeric material comprises a SEBS (Styrene-Ethylene-Butadiene-Styrene) matrix.

17. The pump of claim 16, wherein the at least one elastomeric material further comprises soft and stiff segments therein.

18. The pump of claim 17, wherein the soft segments comprise polyethylene and/or polybutadiene and/or the stiff segments comprise polystyrene.

19. The pump of claim 18, wherein at least one thermoplastic material has a glass transition temperature (Tg) from about 70° C. to about 85° C., such as from about 75° C. to about 80° C.

* * * * *